US011668114B2

(12) United States Patent
Springborn

(10) Patent No.: US 11,668,114 B2
(45) **Date of Patent: *Jun. 6, 2023**

(54) FRICTION PICKET SYSTEM

(71) Applicant: UFP Industries, Inc., Grand Rapids, MI (US)

(72) Inventor: Russell H. Springborn, Howell, MI (US)

(73) Assignee: UFP Industries, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/850,434

(22) Filed: Jun. 27, 2022

(65) Prior Publication Data

US 2022/0325554 A1 Oct. 13, 2022

Related U.S. Application Data

(63) Continuation of application No. 16/682,500, filed on Nov. 13, 2019, now Pat. No. 11,414,885, which is a continuation of application No. 15/786,292, filed on Oct. 17, 2017, now Pat. No. 10,487,534, which is a continuation of application No. 15/246,992, filed on Aug. 25, 2016, now Pat. No. 9,797,158, which is a continuation-in-part of application No. 15/041,663, filed on Feb. 11, 2016, now Pat. No. 9,482,028, and a continuation-in-part of application No. 14/639,562, filed on Mar. 5, 2015, now Pat. No. 9,908,207, and a continuation-in-part of application No. 14/639,570, filed on Mar. 5, 2015, now abandoned.

(Continued)

(51) Int. Cl.

| | |
|---|---|
| ***E04H 17/14*** | (2006.01) |
| ***E04H 17/20*** | (2006.01) |
| ***E04F 11/18*** | (2006.01) |
| ***E04H 15/62*** | (2006.01) |

(52) U.S. Cl.

CPC ..... *E04H 17/1447* (2021.01); *E04F 11/1817* (2013.01); *E04H 15/62* (2013.01); *E04H 17/1417* (2013.01); *E04H 17/1439* (2013.01); *E04H 17/20* (2013.01); *E04F 2011/1825* (2013.01); *E04H 17/1478* (2021.01); *E04H 17/1482* (2021.01)

(58) Field of Classification Search

CPC . E04H 17/14; E04H 17/1421; E04H 17/1426; E04H 17/1439; E04H 17/1443; E04H 17/1478; E04H 17/16

See application file for complete search history.

(56) References Cited

U.S. PATENT DOCUMENTS 3,522,933 A * 8/1970 Braun ..... E04F 11/181 256/22
3,535,204 A * 10/1970 Truxa ..... D21F 1/483 403/381

(Continued)

*Primary Examiner* — Daniel J Wiley
(74) *Attorney, Agent, or Firm* — McGarry Bair PC

(57) ABSTRACT

A railing or fencing assembly may include at least one rail with at least a first retaining element disposed at least partially therein. A baluster may be disposed at least partially in the at least one rail and the at least a first retaining element may be configured to retain the baluster. The railing assembly may include a second railing portion, and the baluster may be disposed at least partially in the second railing portion.

20 Claims, 46 Drawing Sheets

Related U.S. Application Data

(60) Provisional application No. 62/115,004, filed on Feb. 11, 2015, provisional application No. 61/948,523, filed on Mar. 5, 2014, provisional application No. 61/948,545, filed on Mar. 5, 2014.

(56) References Cited

U.S. PATENT DOCUMENTS 3,544,072 A * 12/1970 Thom ..... E04F 11/1802 256/65.16
3,918,686 A * 11/1975 Knott ..... E04F 11/181 256/22
3,973,756 A * 8/1976 Lauzier ..... E04F 11/181 256/65.11
3,975,000 A * 8/1976 Sado ..... E04F 11/181 312/140
3,982,735 A * 9/1976 Fornells ..... E04F 11/1836 256/59
4,014,520 A * 3/1977 Walters ..... E04F 11/1817 256/22
4,027,855 A * 6/1977 Lauzier ..... E04F 11/1844 256/21
4,220,316 A * 9/1980 Naka ..... E04F 11/1836 256/1
4,334,671 A * 6/1982 De Guise ..... E04F 11/181 256/22
4,451,025 A * 5/1984 Spera ..... E04F 11/181 256/22
4,805,879 A * 2/1989 Spera ..... E04F 11/181 256/22
4,968,005 A * 11/1990 Zen ..... E04F 11/181 256/22
5,454,548 A * 10/1995 Moore ..... E04H 17/1439 256/65.16
5,660,378 A * 8/1997 Schall ..... E04H 17/1439 256/22
6,375,166 B1 * 4/2002 Schall ..... E04H 17/1439 256/59
6,702,259 B2 * 3/2004 Pratt ..... E04F 11/1817 256/65.01
6,752,386 B1 * 6/2004 Bundy ..... E04H 17/1439 256/22
6,824,123 B2 * 11/2004 Larsen ..... E04H 17/1439 256/65.12
6,969,051 B1 * 11/2005 Gibbs ..... E04H 17/1439 256/65.01
7,152,849 B2 * 12/2006 Graber ..... F16B 7/0446 256/22
7,384,025 B2 * 6/2008 Lo ..... E04H 17/1439 256/65.13
7,503,551 B2 * 3/2009 Auret ..... E04F 11/1842 256/22
7,635,115 B2 * 12/2009 Lehmann ..... E04H 17/1447 256/22
7,819,390 B2 * 10/2010 Godwin ..... E04H 17/1447 256/22
8,356,801 B2 * 1/2013 Howard ..... E04H 17/1439 256/22
8,413,332 B2 * 4/2013 Duffy ..... E04H 17/1439 29/897.31
8,695,948 B2 * 4/2014 Stinson ..... E04F 11/1817 256/64
8,695,949 B2 * 4/2014 Stinson ..... E04H 17/143 256/64
8,833,737 B2 * 9/2014 Langenwalter ..... E04H 17/1426 256/67
9,027,909 B1 * 5/2015 Peyton ..... E04H 17/1439 256/67
9,151,075 B2 * 10/2015 Duffy ..... E04H 17/1447
2003/0201432 A1 * 10/2003 Norman ..... E04F 11/1817 256/65.08
2004/0188663 A1 * 9/2004 Stein ..... E04H 17/1439 256/59
2005/0045863 A1 * 3/2005 MacKay ..... E04H 17/1447 256/59
2005/0067609 A1 * 3/2005 Walmsley ..... E04H 17/1439 256/65.01
2005/0133777 A1 * 6/2005 Forbis ..... E04F 11/1836 256/59
2008/0121857 A1 * 5/2008 Lo ..... E04H 17/1439 256/65.01
2009/0026431 A1 * 1/2009 Tremblay ..... E04H 17/1439 256/22
2010/0264388 A1 * 10/2010 Duffy ..... E04H 17/1439 256/22
2013/0264532 A1 * 10/2013 Goodman ..... E04H 17/1439 256/65.03
2015/0252588 A1 * 9/2015 Springborn ..... E04H 17/1417 256/65.05

* cited by examiner

FRICTION PICKET SYSTEM

CROSS-REFERENCE TO RELATED APPLICATIONS

This application is a Continuation of (a) U.S. patent application Ser. No. 16/682,500, filed Nov. 13, 2019, now U.S. Pat. No. 11,414,885, issued Aug. 16, 2022, which is a Continuation of (b) U.S. patent application Ser. No. 15/786,292, filed Oct. 17, 2017, now U.S. Pat. No. 10,487,534, issued Nov. 26, 2019, which is a Continuation of (c) U.S. patent application Ser. No. 15/246,992, filed Aug. 25, 2016, now U.S. Pat. No. 9,797,158, issued Oct. 24, 2017, which is a Continuation-in-part of (d) U.S. patent application Ser. No. 15/041,663, filed Feb. 11, 2016, now U.S. Pat. No. 9,482,028, issued Nov. 1, 2016, which claims the benefit of U.S. Provisional Patent Application No. 62/115,004, filed Feb. 11, 2015, further U.S. patent application Ser. No. 15/246,992 is a Continuation-in-part of (e) U.S. patent application Ser. No. 14/639,562, filed Mar. 5, 2015, now U.S. Pat. No. 9,908,207, issued Mar. 6, 2018, which claims the benefit of U.S. Provisional Patent Application No. 61/948,545, filed Mar. 5, 2014, and further U.S. patent application Ser. No. 15/246,992 is a Continuation-in-part of (f) U.S. patent application Ser. No. 14/639,570, filed Mar. 5, 2015, now abandoned, which claims the benefit of U.S. Provisional Patent Application No. 61/948,523, filed Mar. 5, 2014. All of the foregoing applications are hereby incorporated by reference herein in their entireties as though fully set forth herein.

TECHNICAL FIELD

This instant disclosure relates generally to an apparatus for connecting one or more balusters/pickets to a rail of a railing and/or a fence.

BACKGROUND

Conventional railing designs often require a discrete fastener, such as a bolt or a screw to connect a baluster to a rail or a fence. Relative to a design that does not require a discrete fastener, assembling and/or manufacturing railings or fences that require such discrete fasteners may require additional time, cost, larger shipping containers/packaging, and/or effort, which may be associated with centering components, measuring distances between balusters, locating drilling locations, drilling holes, and/or driving fasteners into the holes. A design that may eliminate and/or simplify one or more of the above activities from an assembly process may be desirable.

BRIEF DESCRIPTION OF THE DRAWINGS

The accompanying drawings, which are included to provide a further understanding are incorporated in and constitute a part of this specification, illustrate preferred embodiments and, together with the detailed description, serve to explain the principles of embodiments of the disclosure. In the drawings.

DETAILED DESCRIPTION

Figure 1A:
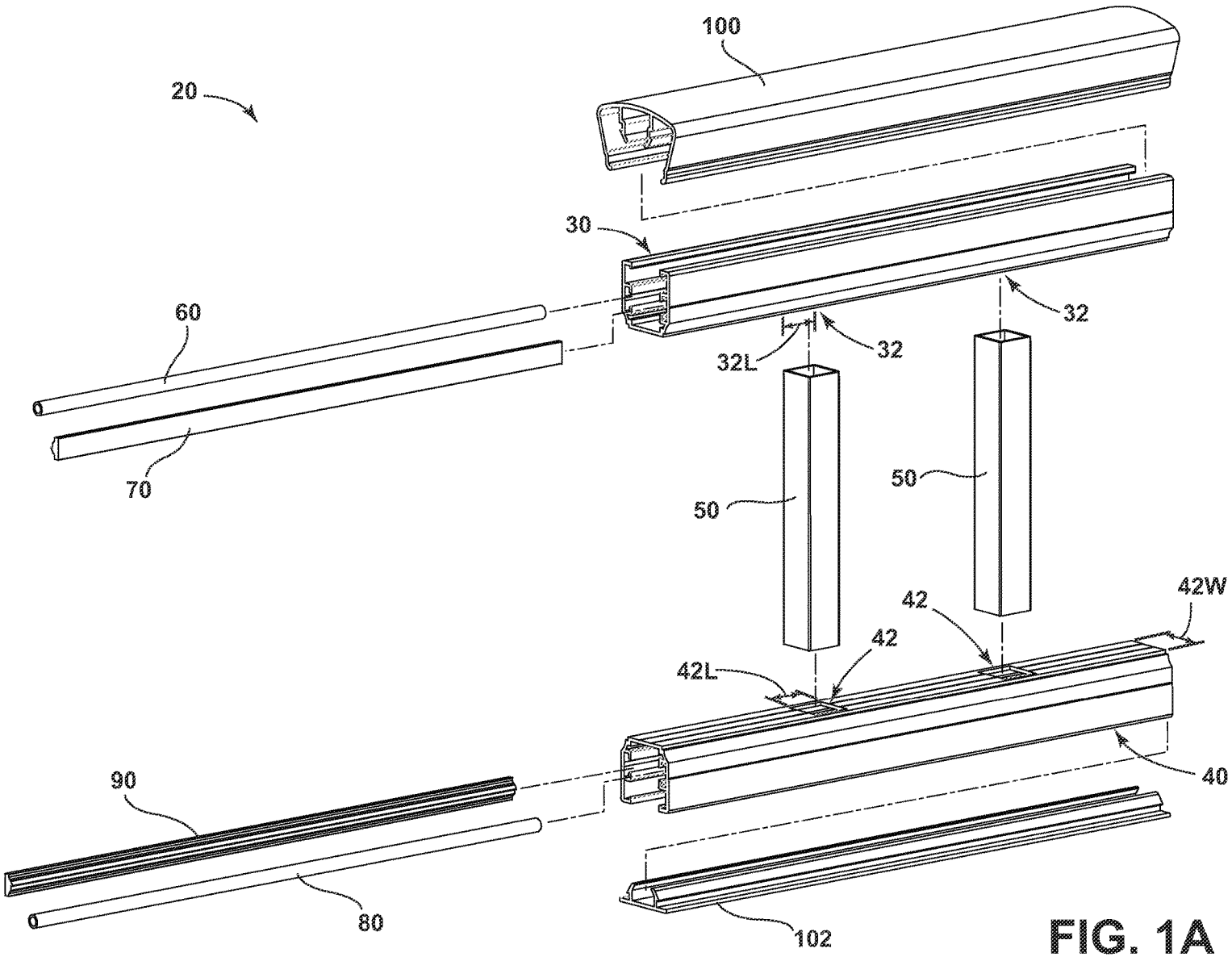
FIGS. 1A-1D are exploded views generally illustrating portions of embodiments of a friction picket system in accordance with teachings of the present disclosure.
Figure 1B:
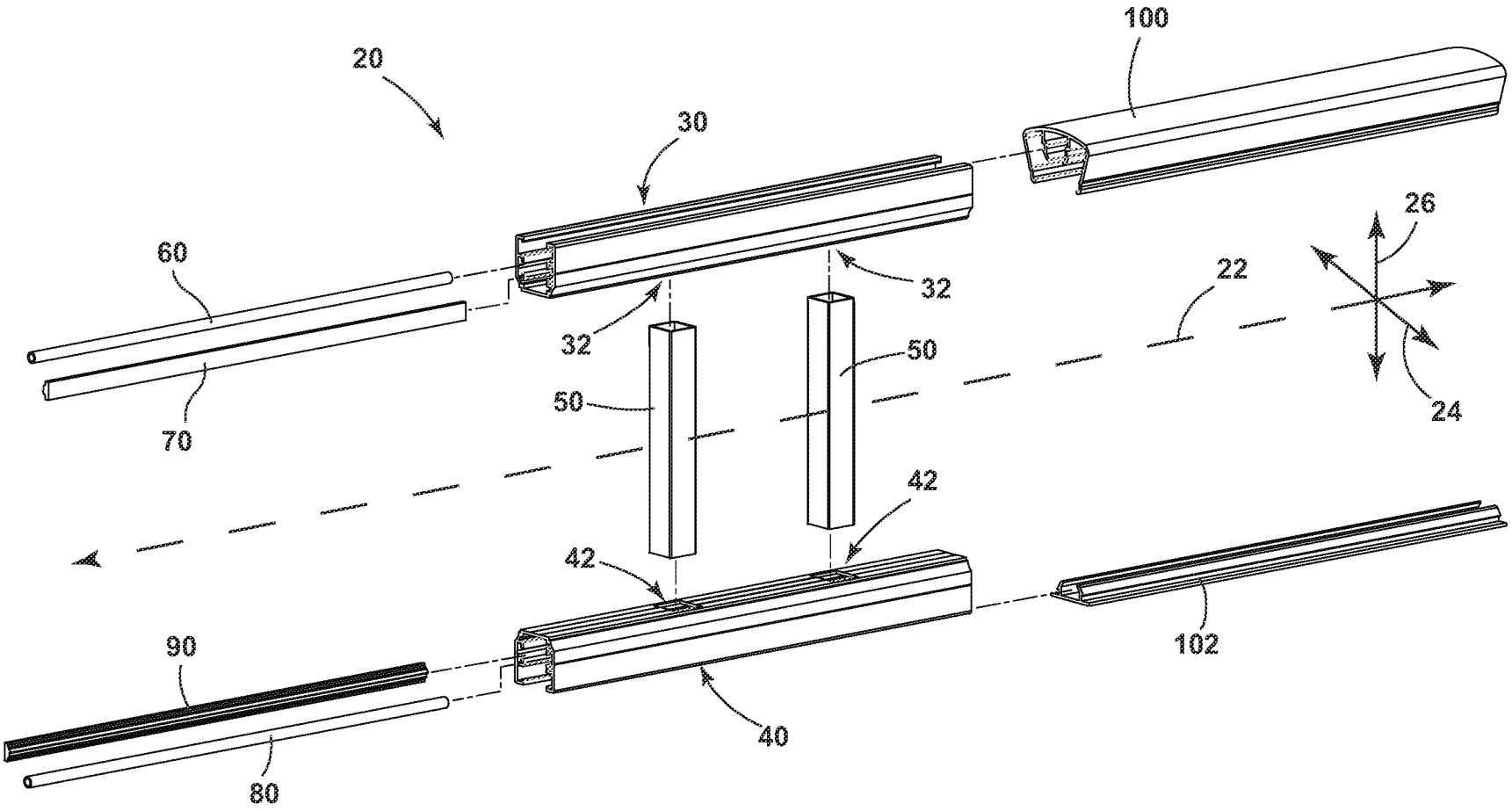

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure.

In embodiments, such as generally illustrated in FIGS. 1A, 1B, 1C, and 1D, a railing assembly 20 (e.g., a friction picket system) may include a first railing portion 30, a second railing portion 40, and/or one or more balusters/pickets 50 that may extend between the first railing portion 30 and the second railing portion 40. A baluster 50 may be inserted into a corresponding aperture 32 of first railing portion 30 and/or into a corresponding aperture 42 of second railing portion 40. The corresponding apertures 32, 42 may include one or more of a variety of shapes sizes, and/or configurations. For example, and without limitation, corresponding apertures 32, 42 may include a generally rectangular and/or elongated shape that may correspond to the shape of the baluster 50. In embodiments, first railing portion 30 may be disposed generally above second railing portion 40, and one or more balusters 50 may support first railing portion 30.

Figure 2:
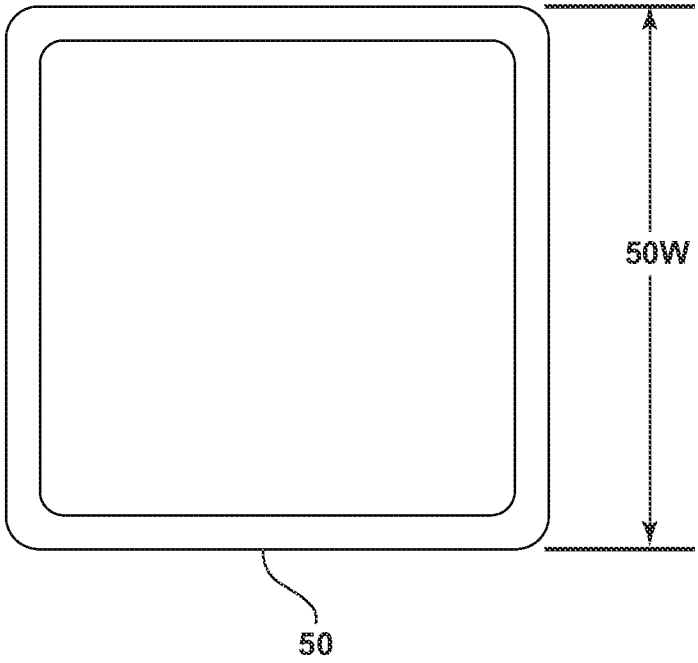
FIG. 2 is a cross-sectional view of an embodiment of a baluster in accordance with teachings of the present disclosure.

In embodiments, such as generally illustrated in FIG. 2, a baluster 50 may include a generally square cross-section and corresponding apertures 32, 42 may include widths 32W, 42W (e.g., perpendicular to a longitudinal axis 22 of railing assembly 20) that are about the same as and/or slightly larger than the widths 50W of walls of the baluster 50 (e.g., a clearance fit). In embodiments, and for example only, widths 50W of the walls of the baluster 50 may be about ¾ of one inch, which may include being about 0.744 inches wide. In embodiments, corresponding apertures 32, 42 of first railing portion 30 and second railing portion 40, respectively, may include lengths 32L, 42L (e.g., which may be generally aligned with longitudinal axis 22) that are longer than the width 50W of the walls of baluster 50, which may allow for the baluster 50 to rotate relative to first railing portion 30 and/or relative to second railing portion 40 about an axis 24 that may be perpendicular to longitudinal axis 22 (e.g., apertures 32, 42 may be elongated in a direction generally parallel to longitudinal axis 22). In embodiments, the lengths 32L, 42L of corresponding apertures 32, 42 of first railing portion 30 and/or second railing portion 40 may allow for first railing portion 30 and/or second railing portion 40 to rotate relative to baluster 50.

Figure 3A:
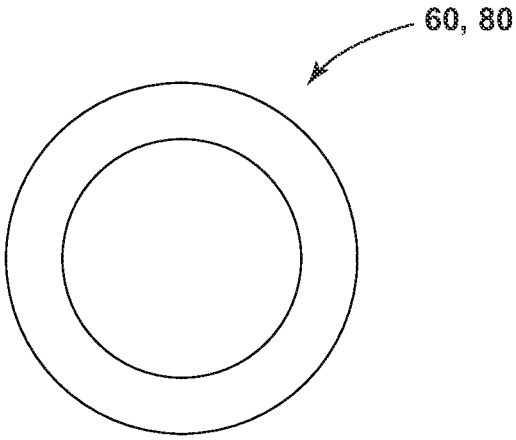
FIG. 3A is a cross-sectional view of an embodiment of a retaining element in accordance with teachings of the present disclosure.

In embodiments, such as generally illustrated in FIGS. 1A, 1B, 1C, 1D, 3A, 3B, 3C, 4A, 4B, 5A, 5B, 6A, 6B, and 6C, first railing portion 30 and/or second railing portion 40 may include one or more retaining elements (e.g., retaining elements 60, 70, 80, 90, 160, 180, 260, 280). For example, and without limitation, first railing portion 30 may include a first retaining element 60 and/or a second retaining element 70, and second railing portion 40 may include a first retaining element 80 and/or a second retaining element 90 (see, e.g., FIGS. 1A, 1B, and 3A). Additionally or alternatively, first railing portion 30 may include first retaining element 160 and/or second retaining element 70, and second railing portion 40 may include first retaining element 180 and/or second retaining element 90 (see, e.g., FIGS. 1C, 1D, and 3B). The first retaining elements 60, 80 and/or the second retaining elements 70, 90 may be configured to help retain one or more balusters 50 relative to respective railing portions 30, 40 once the baluster(s) 50 has been inserted into one or more corresponding apertures 32, 42.

Figure 1C:
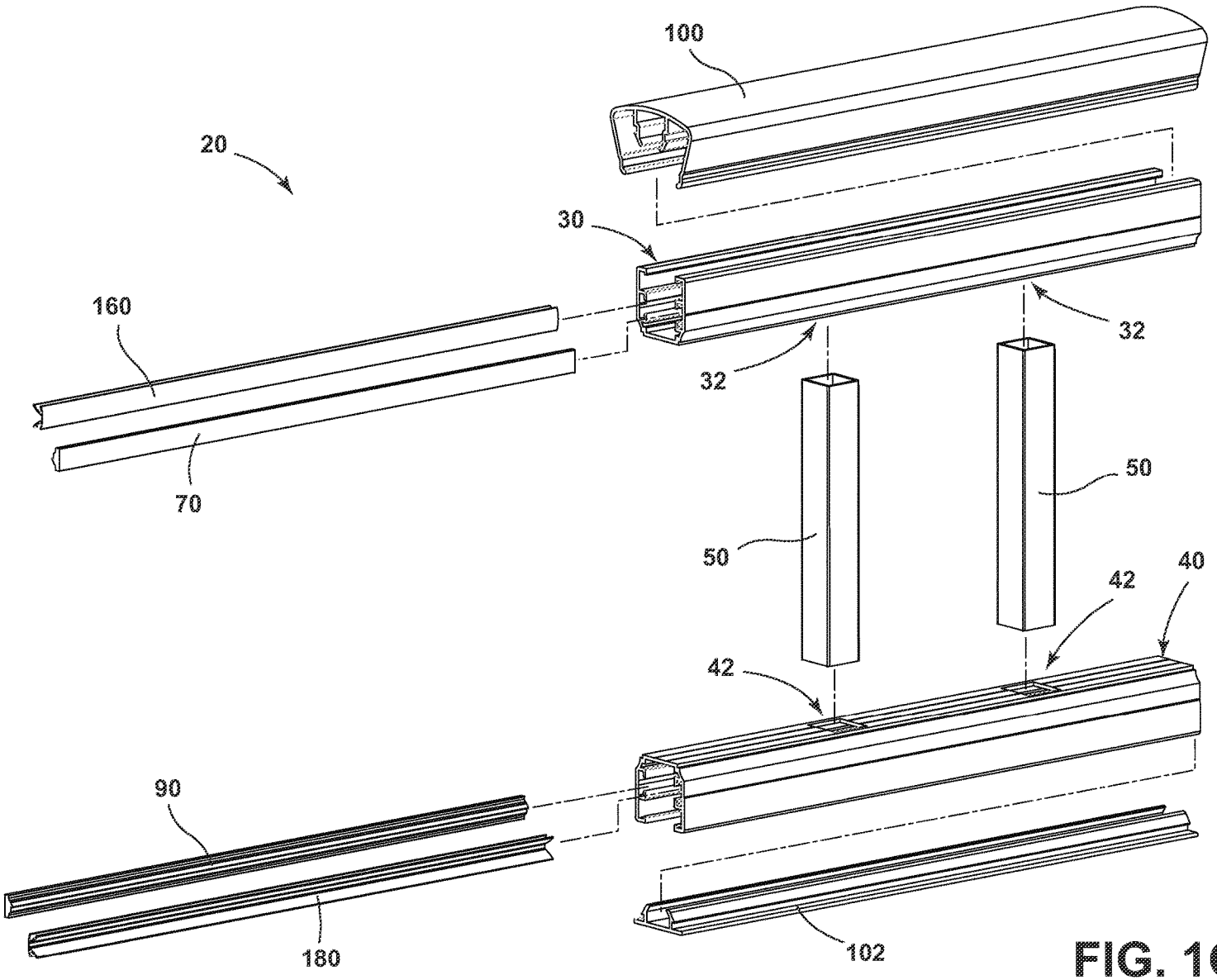
Figure 1D:
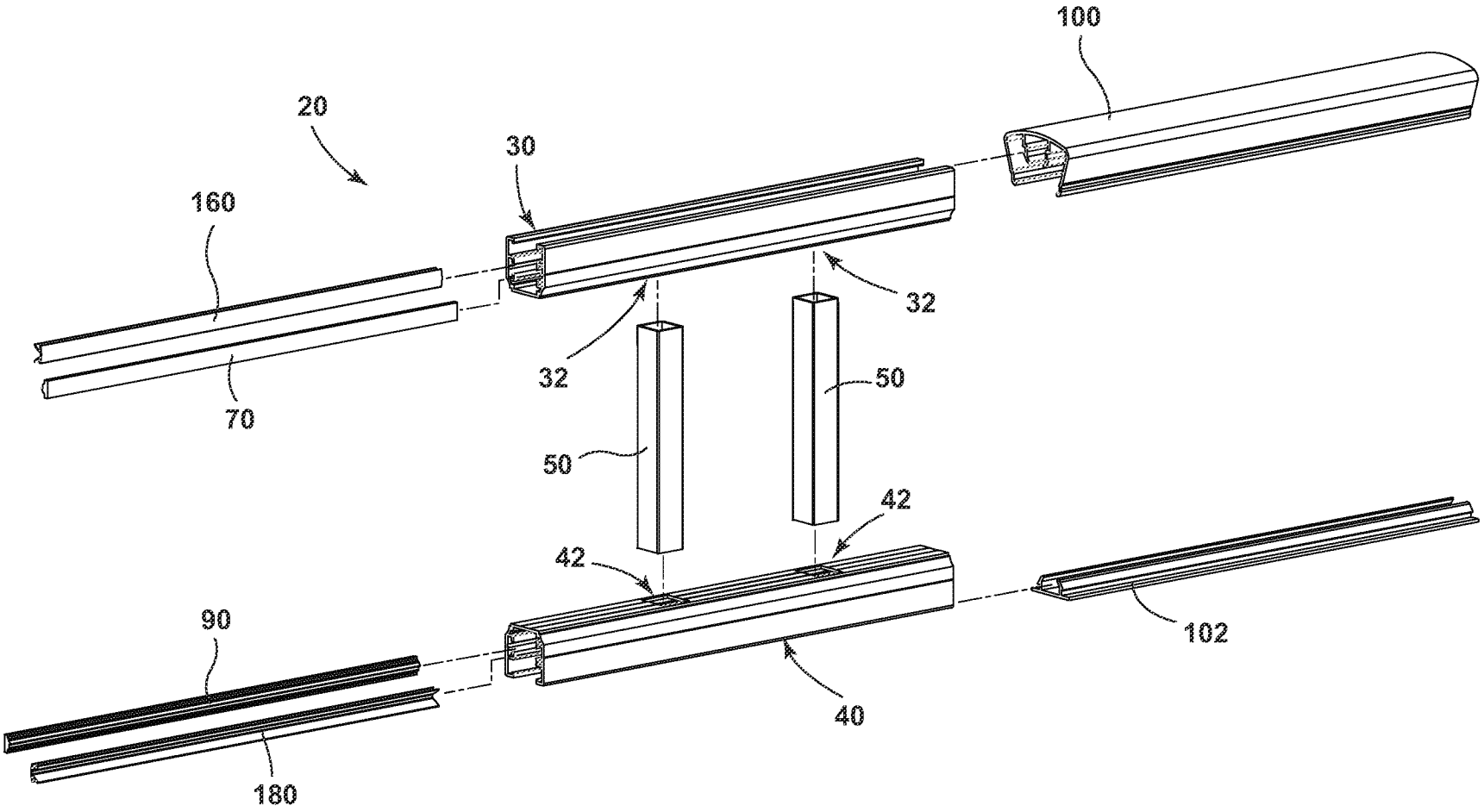
Figure 3B:
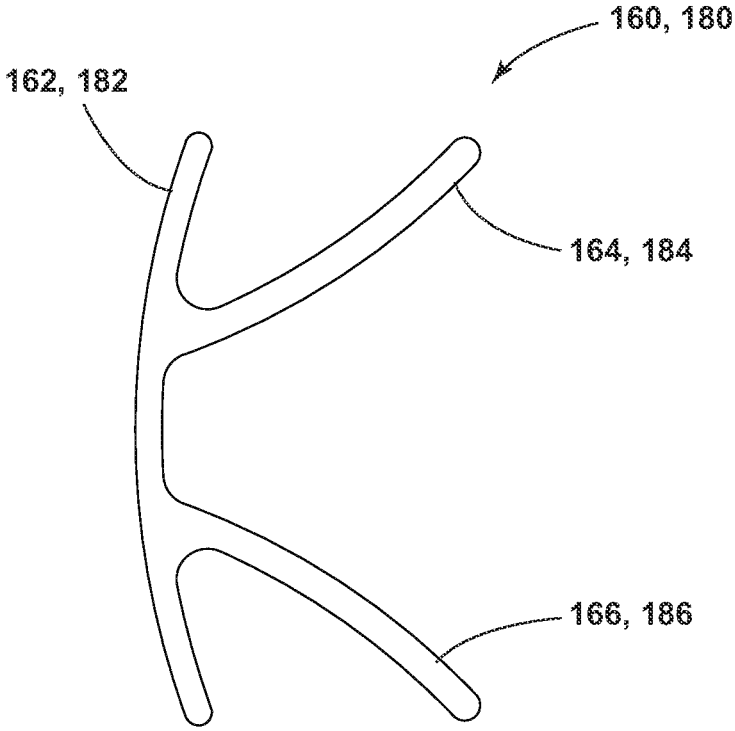
FIG. 3B is a cross-sectional view of an embodiment of a retaining element in accordance with teachings of the present disclosure.
Figure 3C:
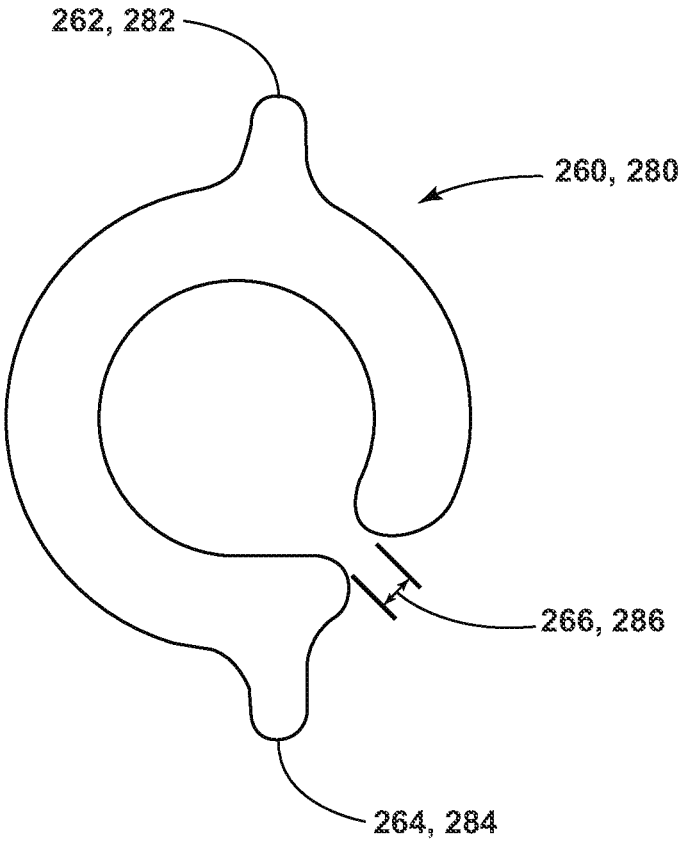
FIG. 3C is a cross-sectional view of an embodiment of a retaining element in accordance with teachings of the present disclosure.
Figure 4A:
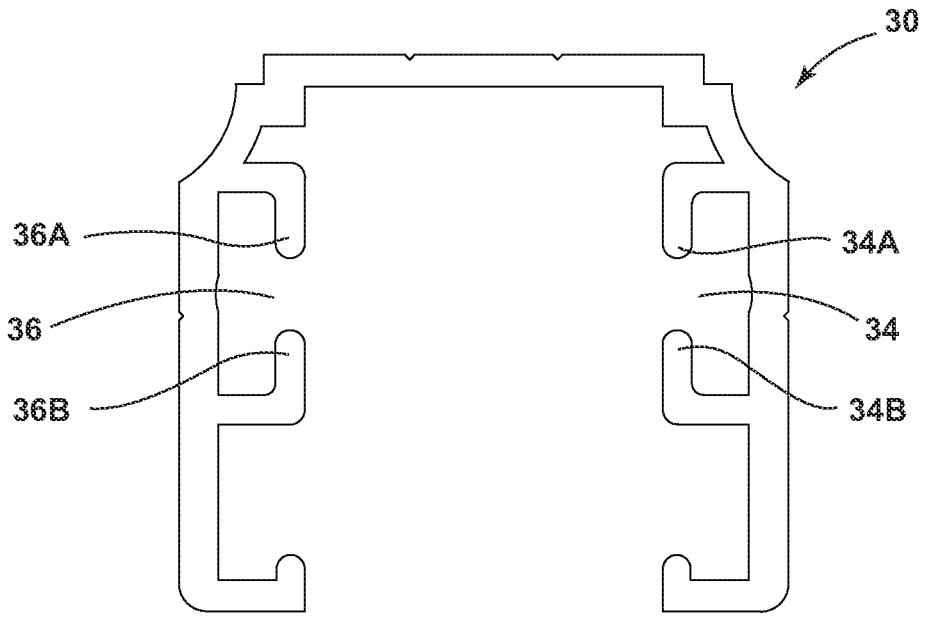
FIG. 4A is a cross-sectional view of an embodiment of a first railing portion in accordance with teachings of the present disclosure.
Figure 4B:
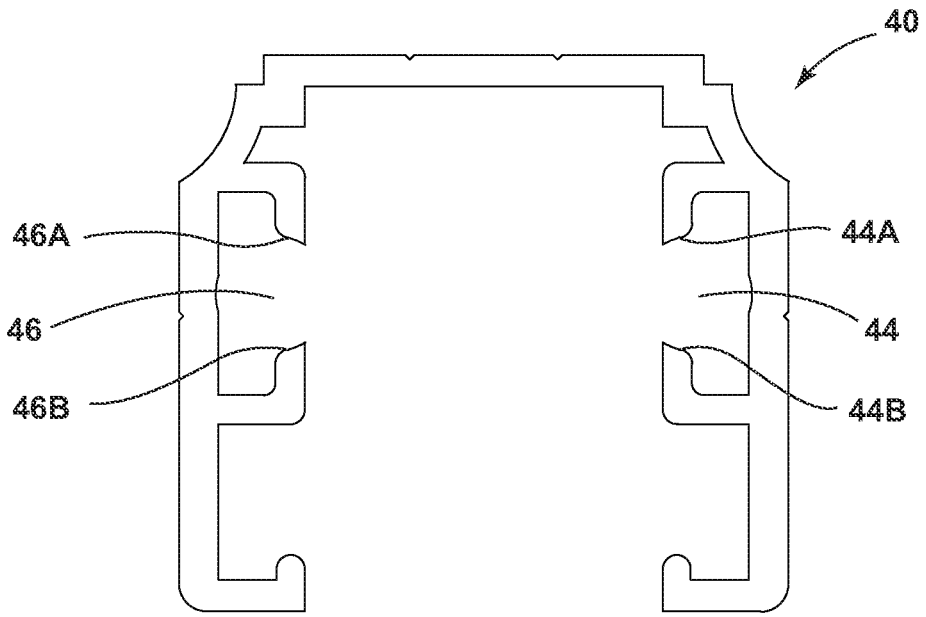
FIG. 4B is a cross-sectional view of an embodiment of a second railing portion in accordance with teachings of the present disclosure.
Figure 5A:
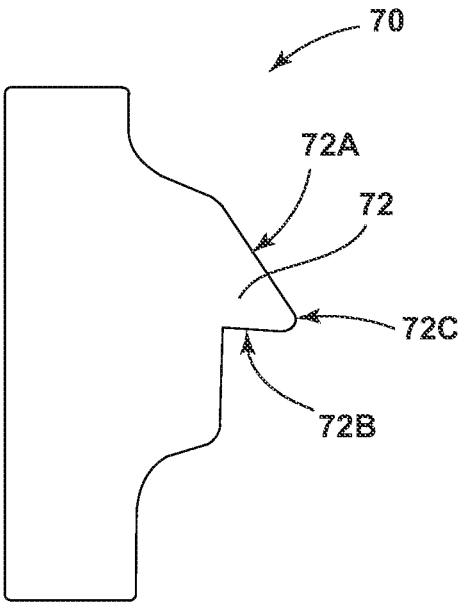
FIGS. 5A and 5B are cross-sectional views of embodiments of retaining elements in accordance with teachings of the present disclosure.
Figure 5B:
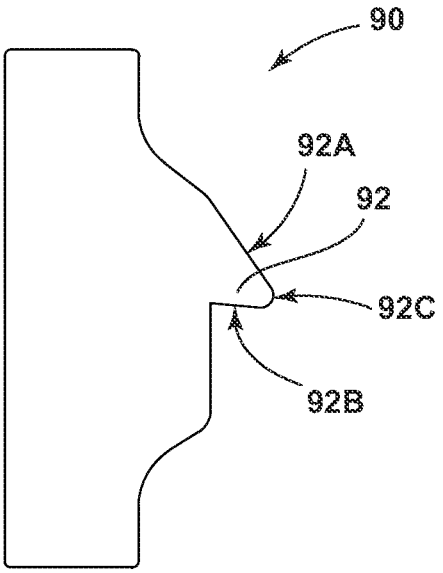
Figure 6A:
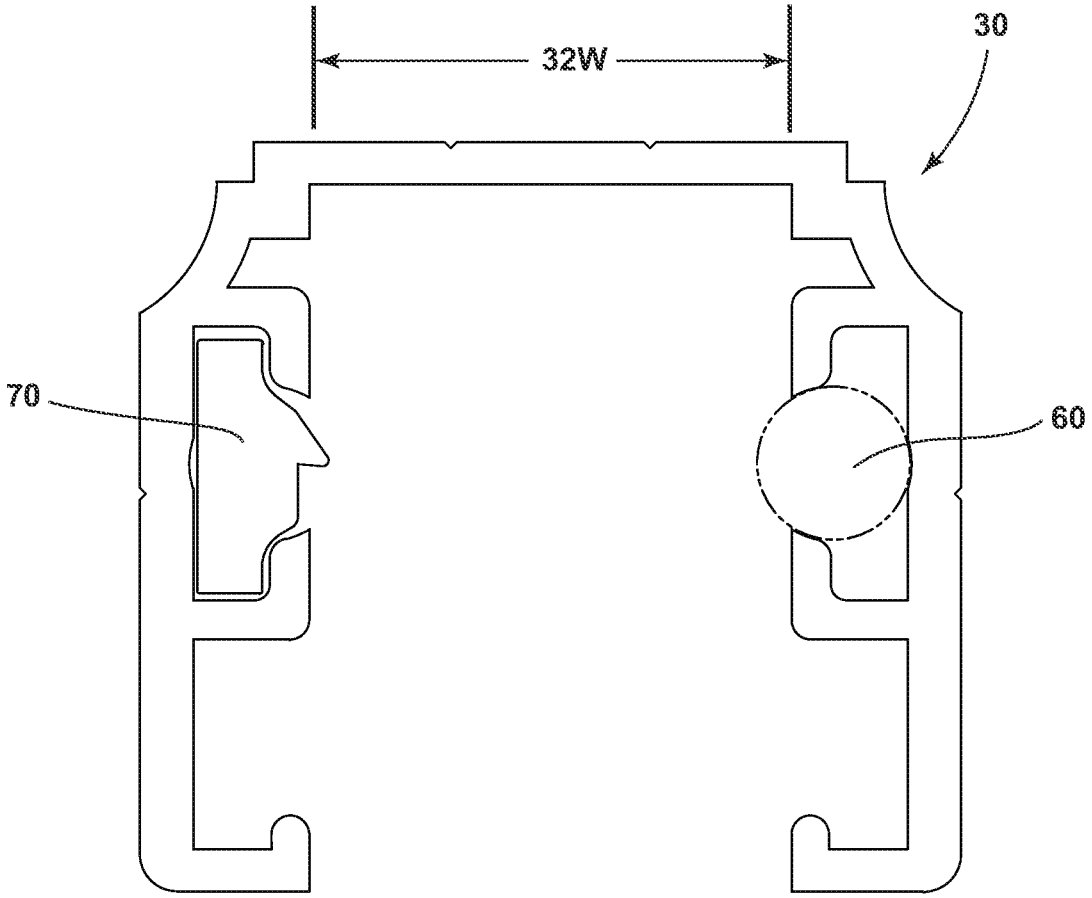
FIG. 6A is a cross-sectional view of embodiments of a railing portion, retaining elements, and a baluster in accordance with teachings of the present disclosure.
Figure 6B:
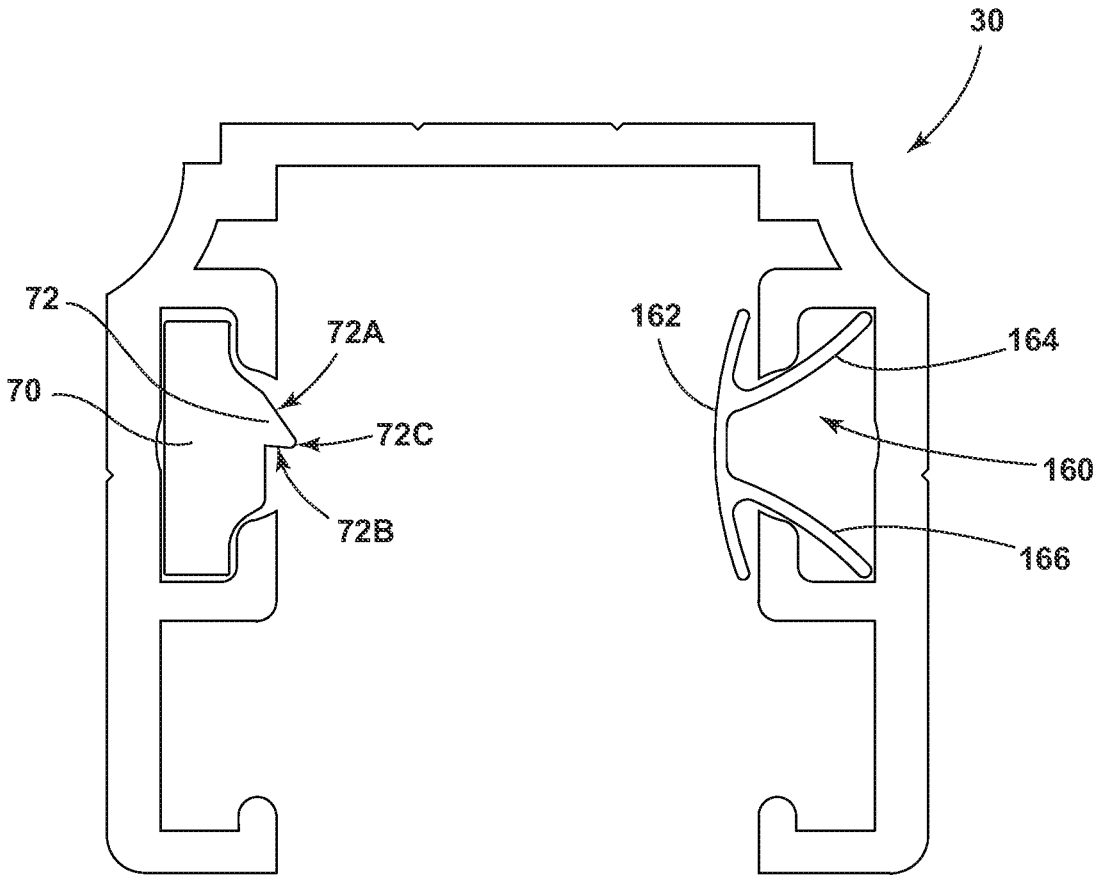
FIG. 6B is a cross-sectional view of embodiments of a railing portion and retaining elements in accordance with teachings of the present disclosure.
Figure 6C:
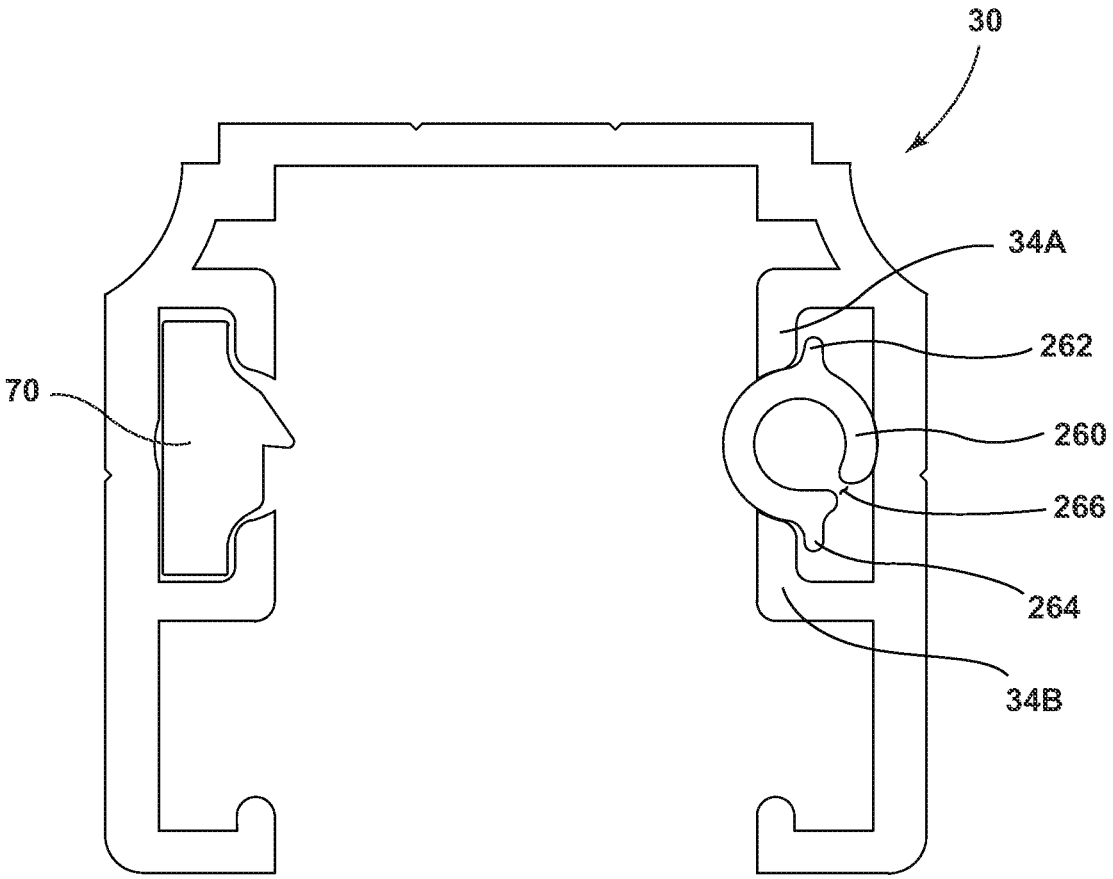
FIG. 6C is a cross-sectional view of embodiments of a railing portion and retaining elements in accordance with teachings of the present disclosure.
Figure 7A:
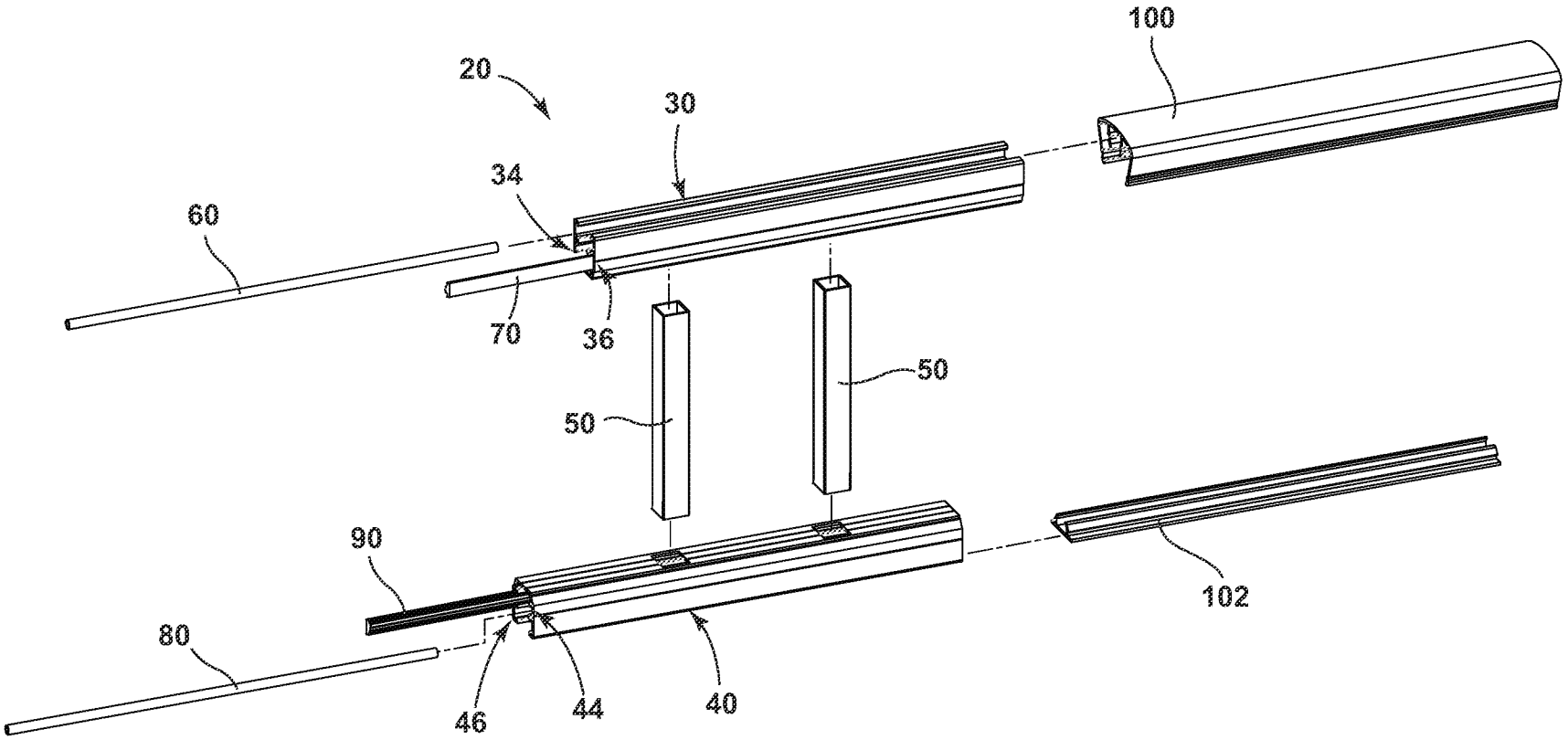
FIGS. 7A-9B are exploded perspective views generally illustrating portions of embodiments of a friction picket system in accordance with teachings of the present disclosure.
Figure 7B:
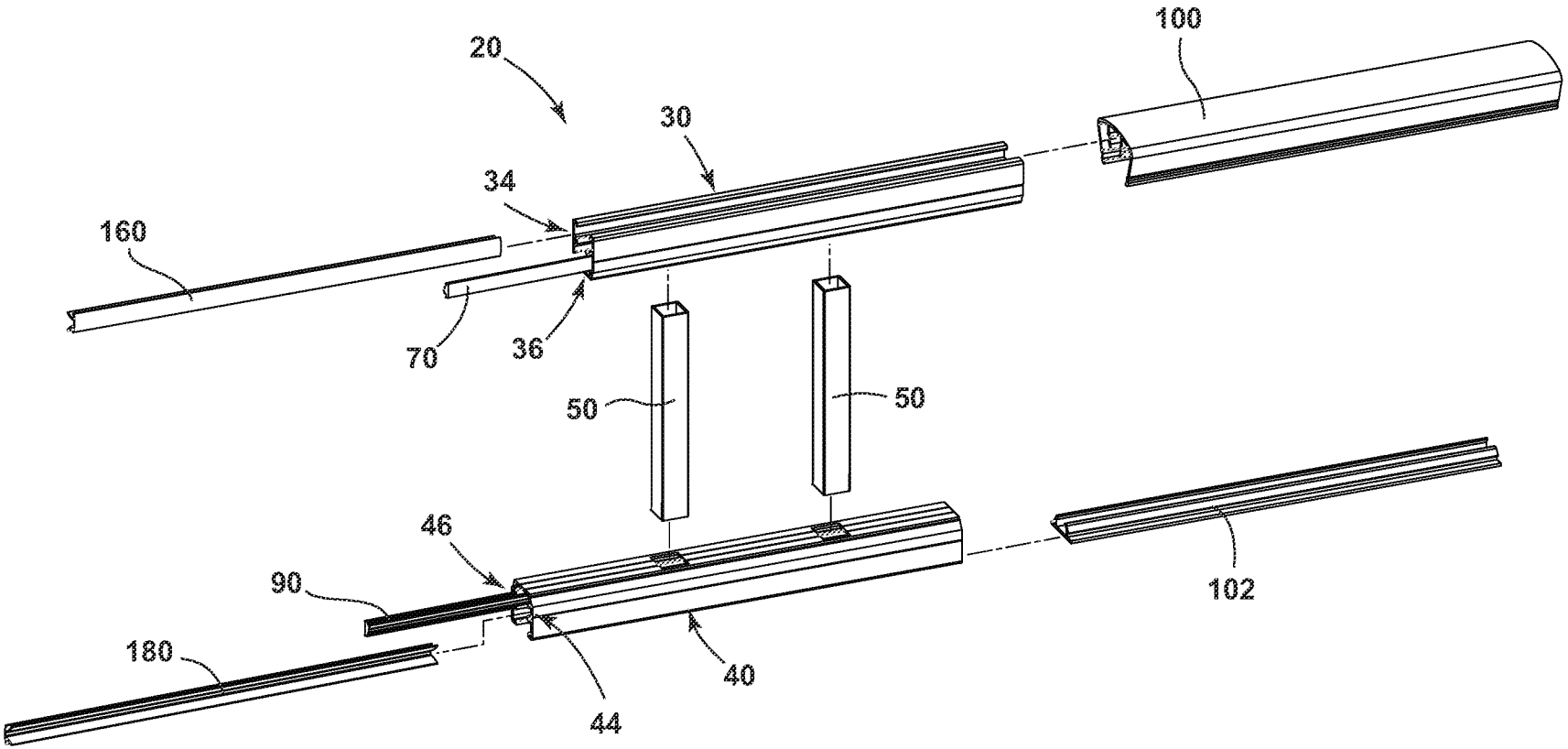
Figure 8A:
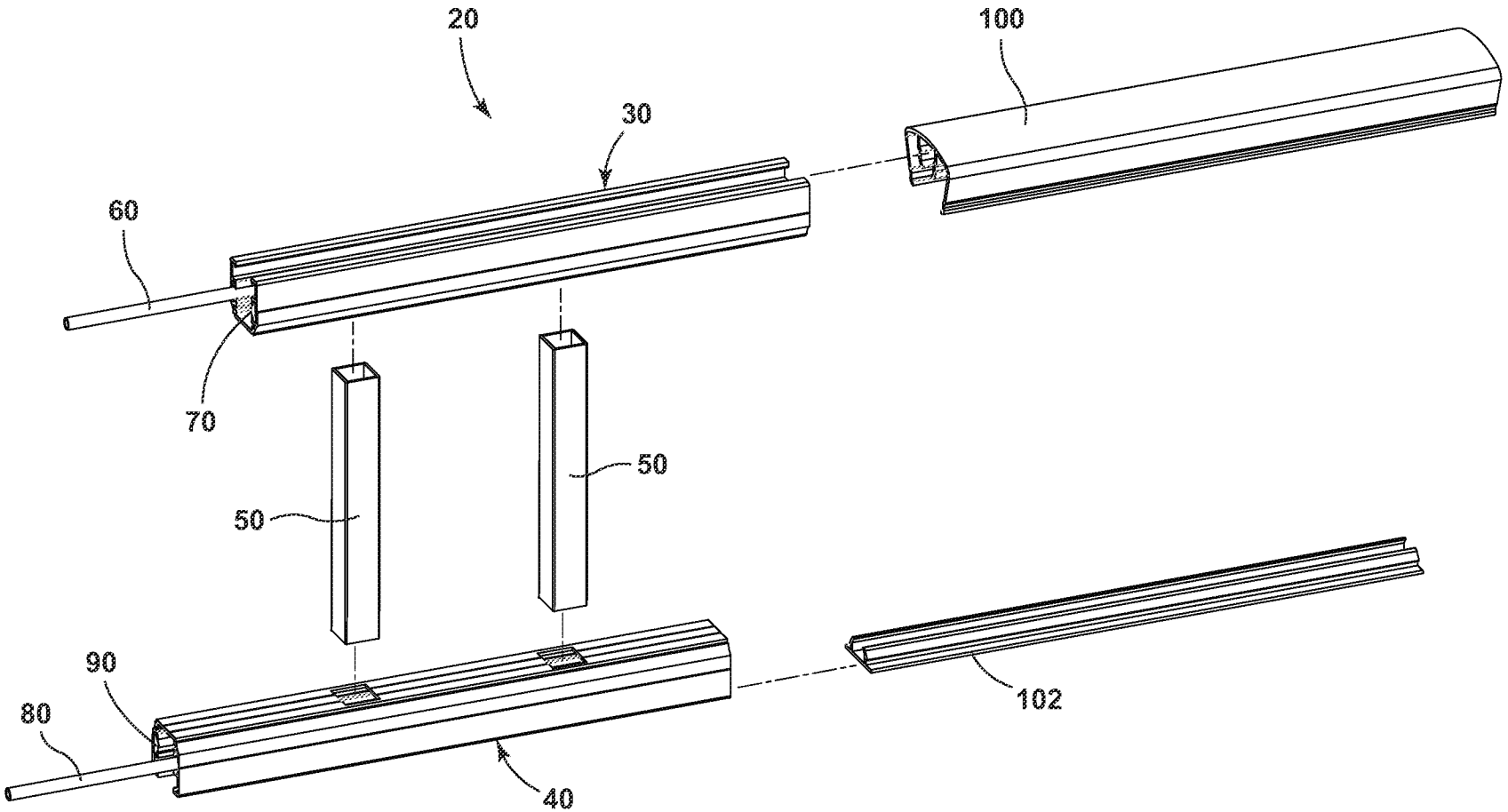
Figure 8B:
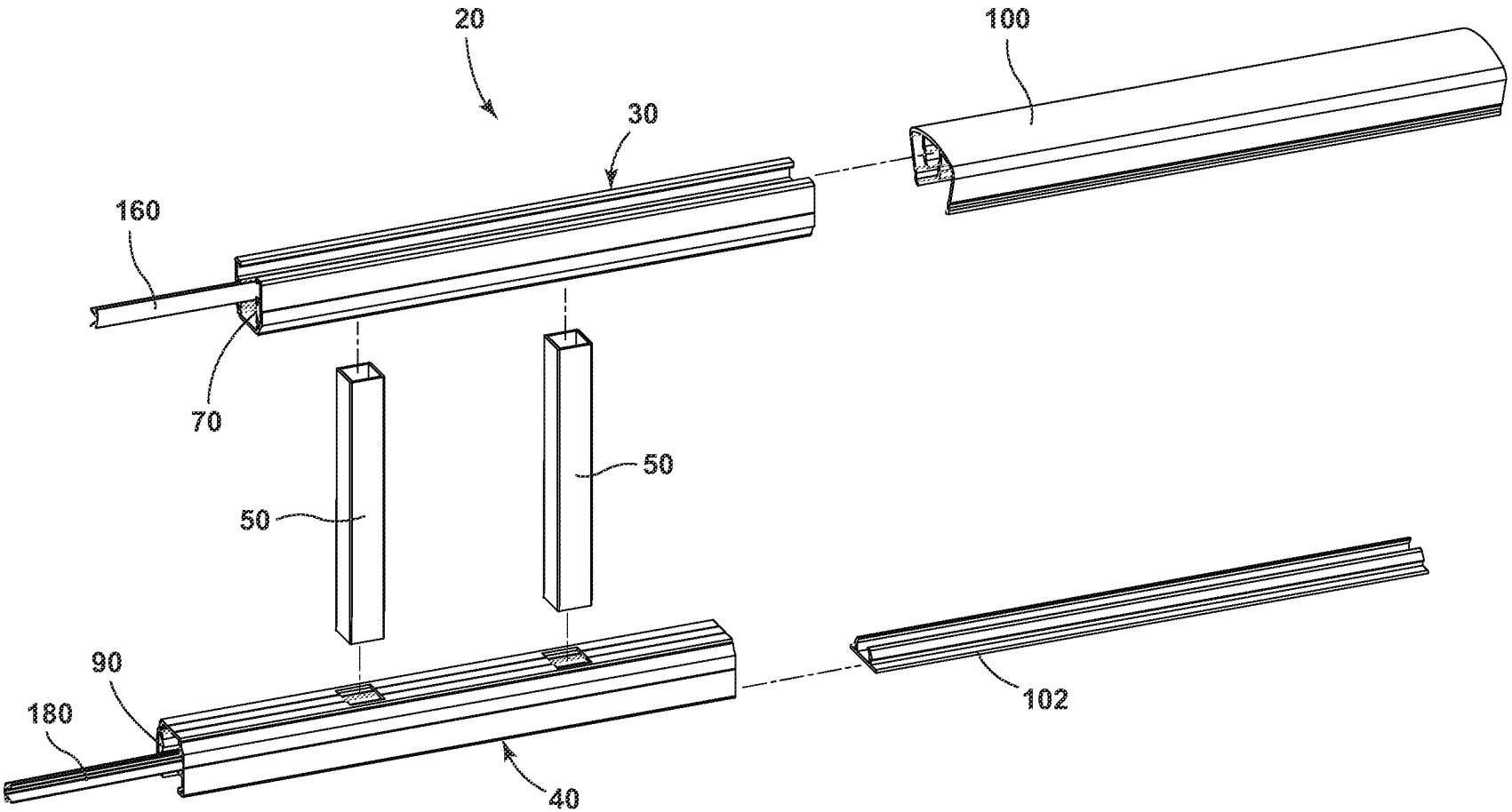

In embodiments, first retaining elements 60, 80, 160, 180, 260, 280 may include one or more of a variety of shapes, sizes, and/or configurations. For example, and without limitation, first retaining elements (e.g., elements 60, 80) may be configured as a resilient tube, such as a polyethylene, vinyl, or polymer tube, and/or may be referred to herein as tubes 60, 80, but are not so limited. In embodiments, first retaining elements (e.g., elements 160, 180) may include a generally K-shaped configuration, such as generally illustrated in FIGS. 1C, 1D, and 3B. In embodiments, first retaining element 160 and first retaining element 180 may include similar configurations and/or the same configurations. First retaining elements 160, 180 may each include a base 162, 182, a first leg 164, 184, and/or a second leg 166, 186. Bases 162, 182 may include a curved configuration and may be curved outward (e.g., such that the distances between bases 162, 182 and legs 164, 166, 184, 186 is less than if bases 162, 182 were not curved). In embodiments, the curvature of bases 162, 182 may be configured to cause and/or promote friction with balusters 50. For example, and without limitation, upon initial insertion of a baluster 50 into an aperture (e.g., aperture 32, 42), a baluster 50 may initially contact a base 162, 182 while the base 162, 182 includes a curved configuration. If insertion is continued, the baluster 50 may flatten out the base 162, 182, at least to some degree, but the base 162, 182 may continue to apply a biasing/retaining force to the baluster 50.

In embodiments, first retaining elements 260, 280 may include a C-shaped configuration (see, e.g., FIGS. 3C, 6C, and 20A-21D). For example, and without limitation, first retaining elements 260, 280 may include a generally cylindrical shape that may include a gap 266, 286 that may extend along its length, which may provide retaining elements 260, 280 with a generally C-shaped cross section. The gap 266, 286 may allow for easier insertion of first retaining elements 260, 280 into a railing portion (e.g., channels 236, 244 of railing portions 230, 240), such as by allowing for manufacturing tolerances.

Retaining elements 260, 280 may include protrusions 262, 264, 282, 284 that may extend radially outward. Protrusions 262, 264, 282, 284 may be configured to help maintain retaining elements 260, 280 in a railing portion 230, 240. For example, and without limitation, first protrusions 262, 282 may be configured to engage protrusions 234A, 244A of railing portions 230, 240, and/or second protrusions 264, 284 may be configured to engage protrusions 234B, 244B of railing portions 230, 240. First protrusions 262, 282 and second protrusions 264, 284 may be disposed at a distance from each other, such as about 180 degrees from each other. In embodiments, second protrusions 264, 284 may be disposed at or about gaps 266, 286.

In embodiments, such as generally illustrated in FIGS. 4A, 4B, 6A, 6B, 6C, 10A, and 10B, first retaining elements 60, 160, 80, 180, 260, 280 may be disposed at least partially in channels 34, 44 of first railing portion 30 and second railing portion 40, respectively, that may be formed by opposing L-shaped protrusions (e.g., protrusions 34A, 34B, 44A, 44B) that may limit movement of the first retaining elements 60, 80 (e.g., may limit movement in directions not generally parallel with longitudinal axis 22). First retaining elements 60, 160, 80, 180, 260, 280 may be slid into the channels 34, 44 from ends of the first railing portion 30 and/or the second railing portion 40. For example, and without limitation, first legs 164, 184 and/or second legs 166, 186 of first retaining elements 160, 180 may be disposed at oblique angles relative to bases 162, 182 (e.g., may include a K-shaped configuration) and may be disposed substantially within channels 34, 44. Bases 162, 182 may be disposed outside of channels 34, 44 and/or may be disposed at or near, and/or may abut protrusions 34A, 34B, 44A, 44B.

In embodiments, first retaining elements 60, 160, 80, 180, 260, 280 may be configured to bias and/or apply a force to a baluster 50 in a direction generally parallel to axis 24 (e.g., toward a second retaining element 70, 90) once the baluster 50 has been inserted into an aperture 32, 42. For example, and without limitation, a diameter of first retaining elements 60, 80, 260, 280 may be sufficiently large such that at least a portion of first retaining elements 60, 80, 260, 280 may extend out of channels 34, 44, (and/or channels 234, 244 of railing portions 230, 240 of FIGS. 18A-21D, for example) to contact and/or apply a force to baluster 50. In embodiments in which first retaining elements 160, 180 include curved bases 162, 182, the curvature may be outward (e.g., beyond protrusions 34A, 34B, 44A, 44B) to contact and/or apply a force to baluster 50. Additionally or alternatively, first retaining elements 60, 160, 80, 180, 260, 280 may be sufficiently flexible to allow an inserted baluster 50 to rotate relative to first railing portion 30 and/or second railing portion 40 to a desired stair angle about axis 24 or an axis generally parallel to axis 24 (e.g., from an initial angle of 0 degrees, relative to vertical axis 26 to a desired stair angle that may be between 0 degrees and 40 degrees).

In embodiments, such as generally illustrated in FIGS. 5A, 5B, 6A, 6B, 6C, second retaining elements 70, 90 may include one or more of a variety of shapes, sizes, and/or configurations. For example, and without limitation, second retaining elements 70, 90 may be configured as a pressure insert that may include a tab 72, 92, and/or second retaining elements 70, 90 may be referred to herein as pressure inserts 70, 90, but are not so limited. In embodiments, tabs 72, 92 and/or a pressure inserts 70, 90 may be relatively rigid (e.g., relative to first retaining elements 60, 80, 160, 180, 260, 280) and/or may comprise aluminum. Pressure inserts 70, 90 may be disposed and/or inserted into a channel of a railing portion (e.g., channel 36 of first railing portion 30 and/or channel 46 of second railing portion 40). Channels 36, 46 may be formed and/or defined by opposing L-shaped protrusions 36A, 36B, 46A, 46B that may limit movement of pressure inserts 70, 90.

In embodiments, tabs 72, 92 may include one or more of a variety of shapes, sizes, and/or configurations. For example, and without limitation, tabs 72, 92 may each include a generally triangular shape. In embodiments, an angled wall 72A, 92A (e.g., angled relative to horizontal and vertical directions) of a tab 72, 92 may be disposed such that a baluster 50 may initially contact the angled wall 72A, 92A upon insertion. In embodiments, a generally horizontal wall 72B, 92B of a tab 72, 92 may be disposed adjacent to an angled wall 72A, 92A such that the tab 72, 92 includes an end/point 72C, 92C that may contact a baluster 50 once the baluster 50 has been inserted a sufficient distance. Horizontal wall 72B, 92B may not be completely horizontal and/or may be disposed at an oblique angle relative to a horizontal direction, such as, for example, a five degree angle. In embodiments, pressure inserts 70, 90 may include a generally rectangular shape and/or tabs 72, 92 may extend inward toward a middle of first railing portion 30 and/or a middle of second railing portion 40. In embodiments, pressure inserts 70, 90 may be slid into the channels 36, 46 from ends of the first railing portion 30 and/or the second railing portion 40.

In embodiments, a railing assembly 20 may include a top cover 100 that may be decorative and/or configured for a user to hold, such as when using stairs. Top cover 100 may be connected (e.g., coupled and/or snapped) to a railing portion (e.g., first railing portion 30). In embodiments, top cover 100 may be disposed about a railing portion such that it covers some or all of the railing portion. Top cover 100 may be connected internally to the railing portion. For example, and without limitation, top cover 100 may include protrusions 100A, 100B that may extend toward the railing portion (e.g., vertically) and/or may be configured to engage with inwardly extending flanges of the railing portion (e.g., flanges 38A, 38B of first railing portion 30). Additionally or alternatively, a railing assembly 20 may include a bottom cover 102 that may be coupled and/or snapped to a railing portion (e.g., second railing portion 40). In embodiments, cover 102 may slide into a railing portion such that cover 102 is connected with the railing portion internally. For example, and without limitation, bottom cover 102 may include protrusions 102A, 102B that may extend toward the railing portion (e.g., vertically) and/or may be configured to engage with inwardly extending flanges of the railing portion (e.g., flanges 48A, 48B of second railing portion 40).

Figure 9A:
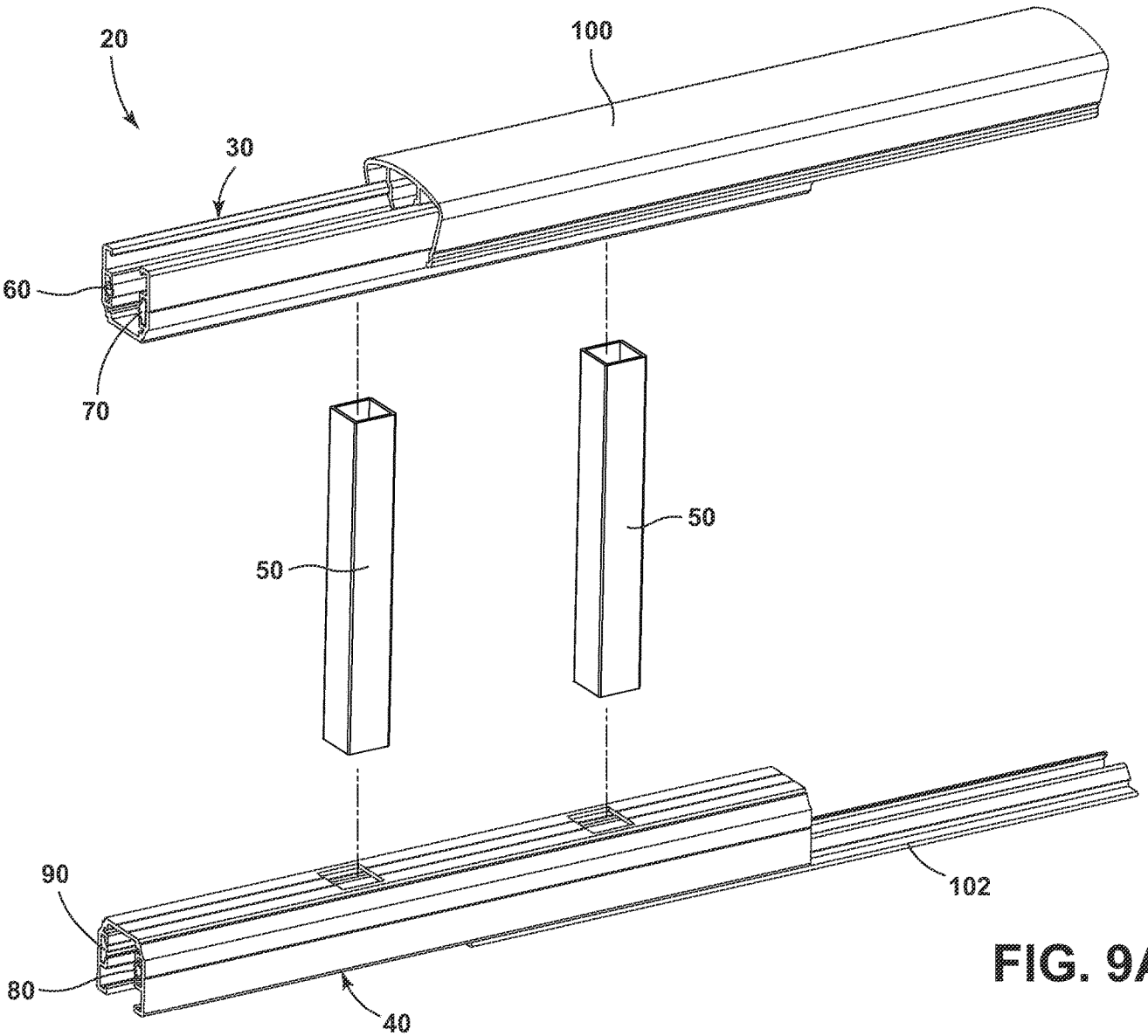
Figure 9B:
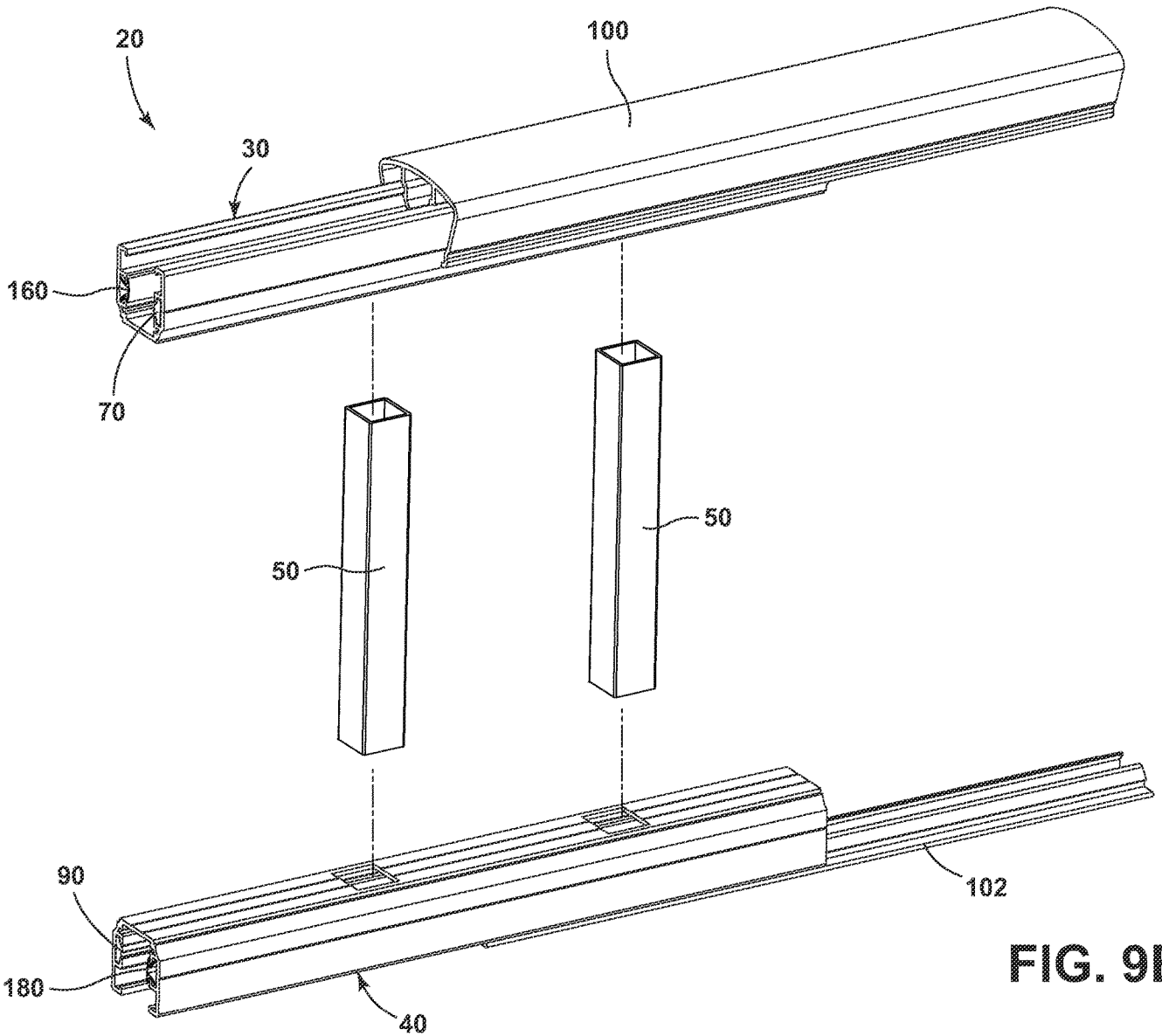
Figure 10A:
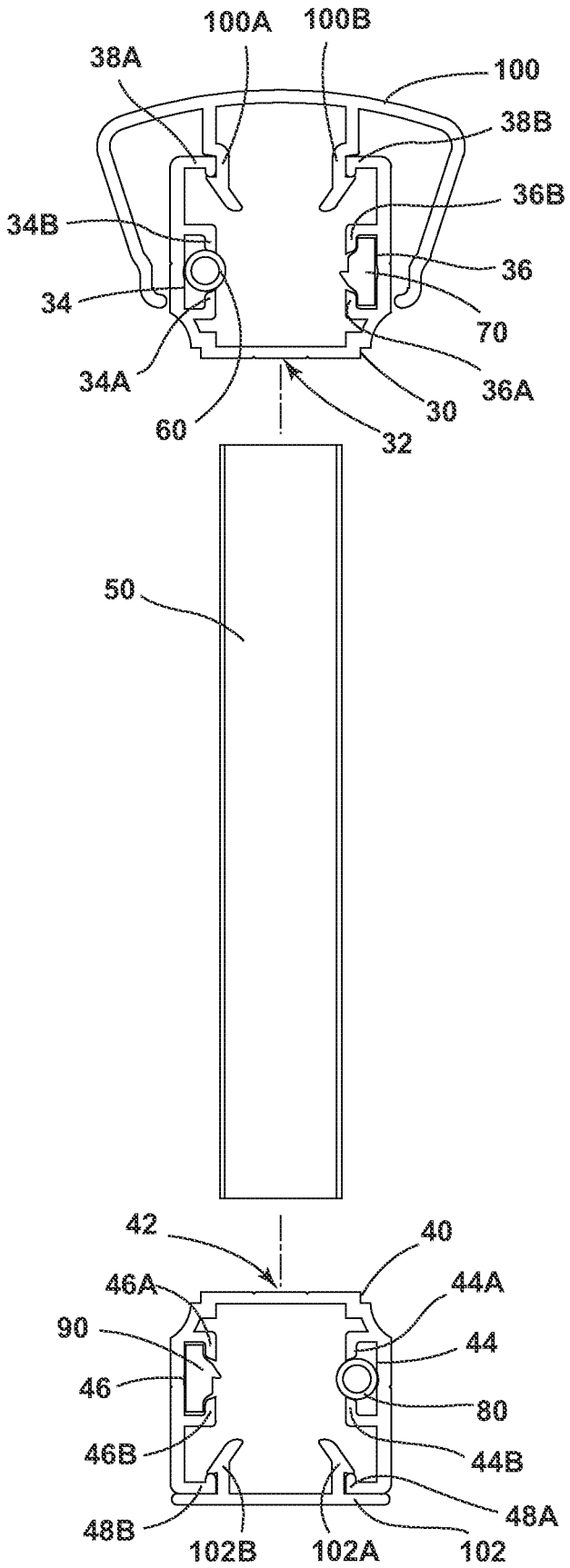
FIGS. 10A and 10B are exploded cross-sectional views of embodiments of a friction picket system in accordance with teachings of the present disclosure.
Figure 10B:
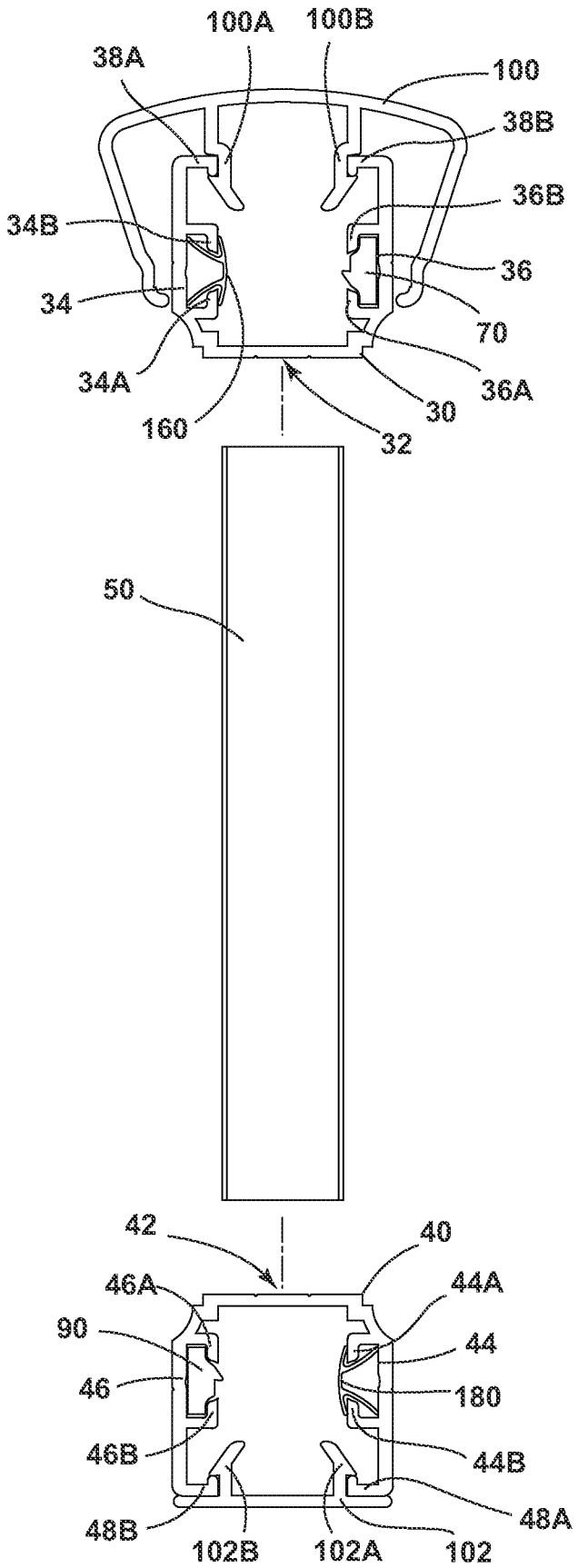
Figure 11A:
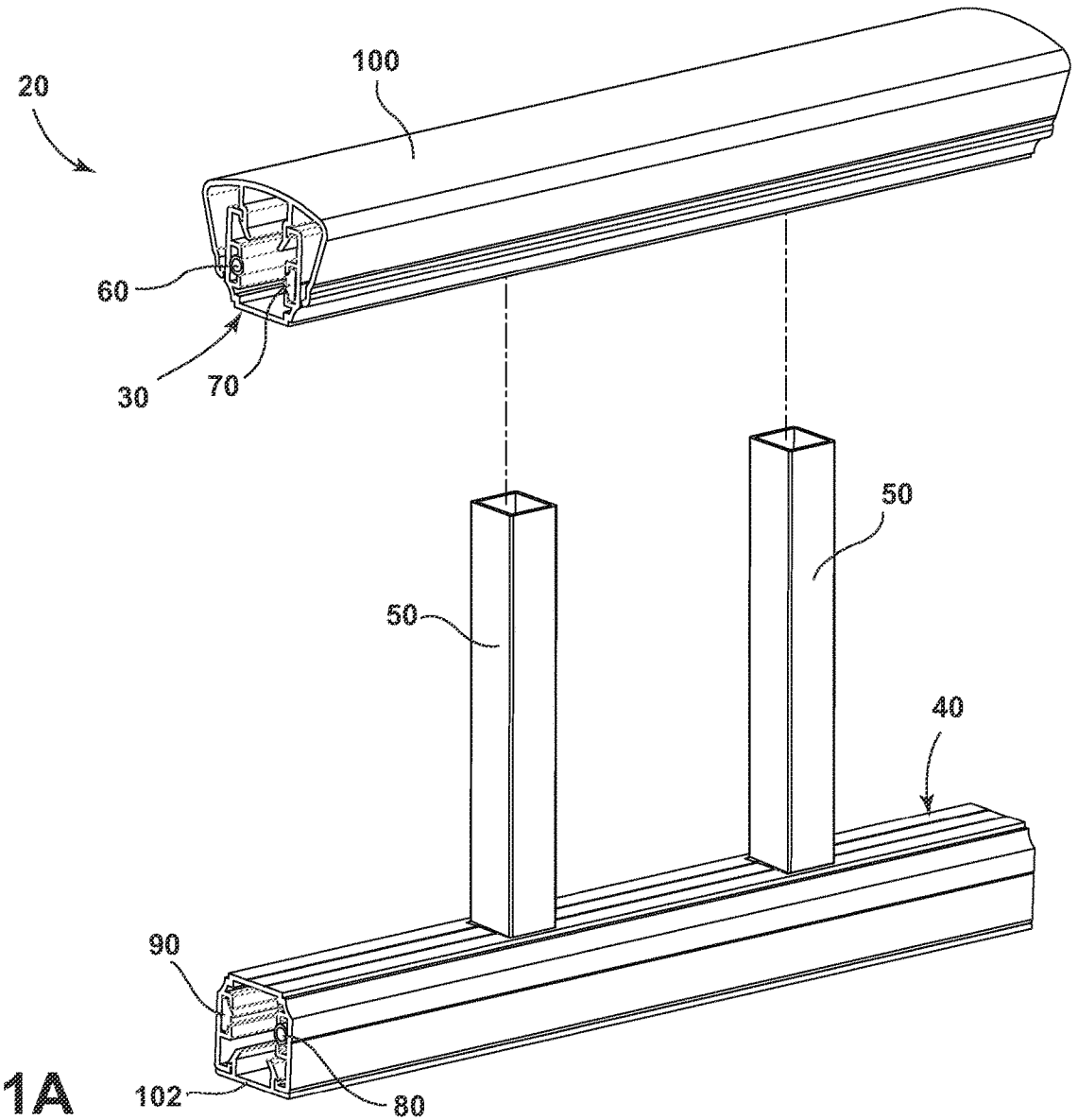
FIGS. 11A and 11B are exploded perspective views generally illustrating portions of embodiments of a friction picket systems in accordance with teachings of the present disclosure.
Figure 11B:
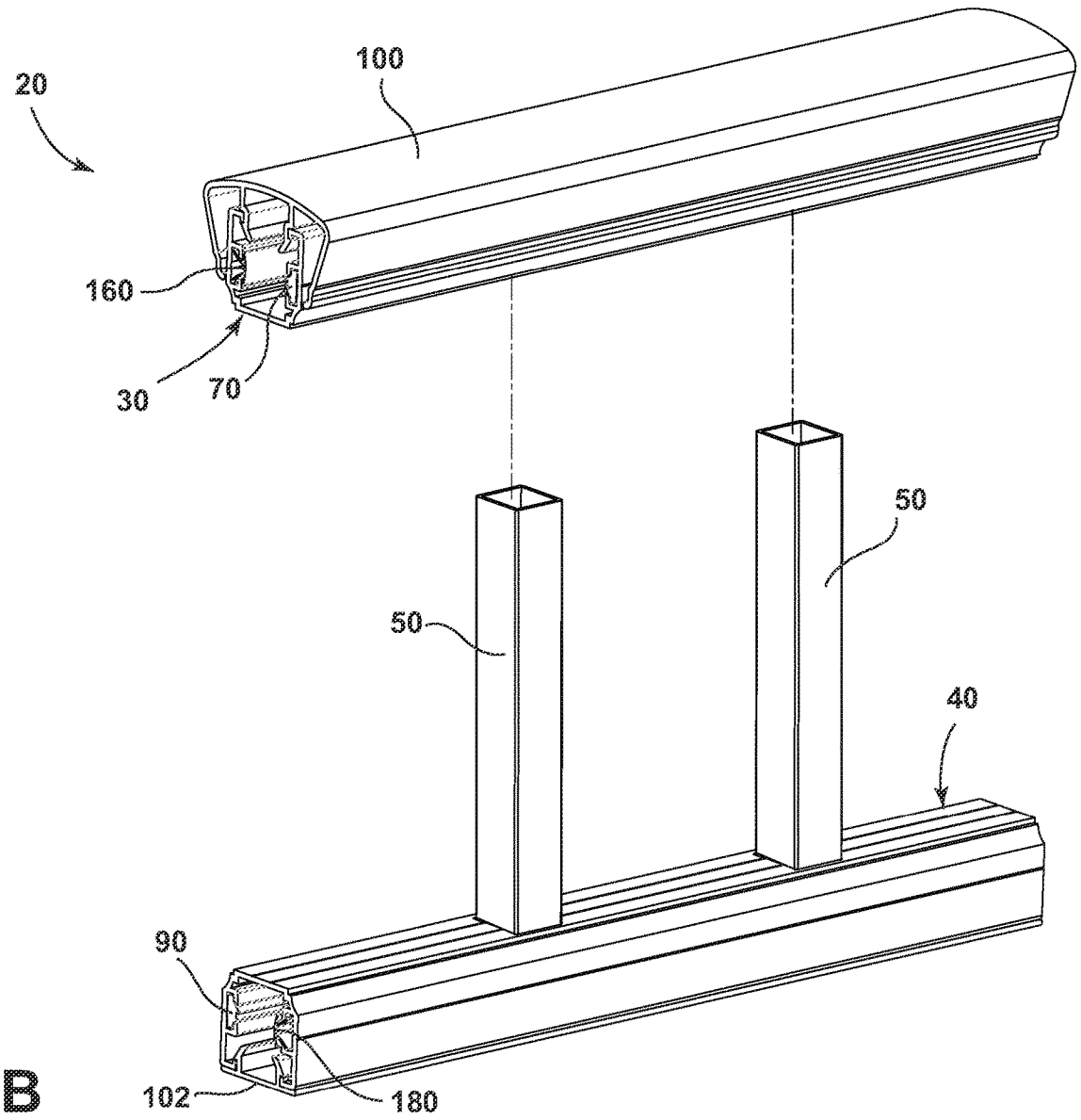
Figure 12A:
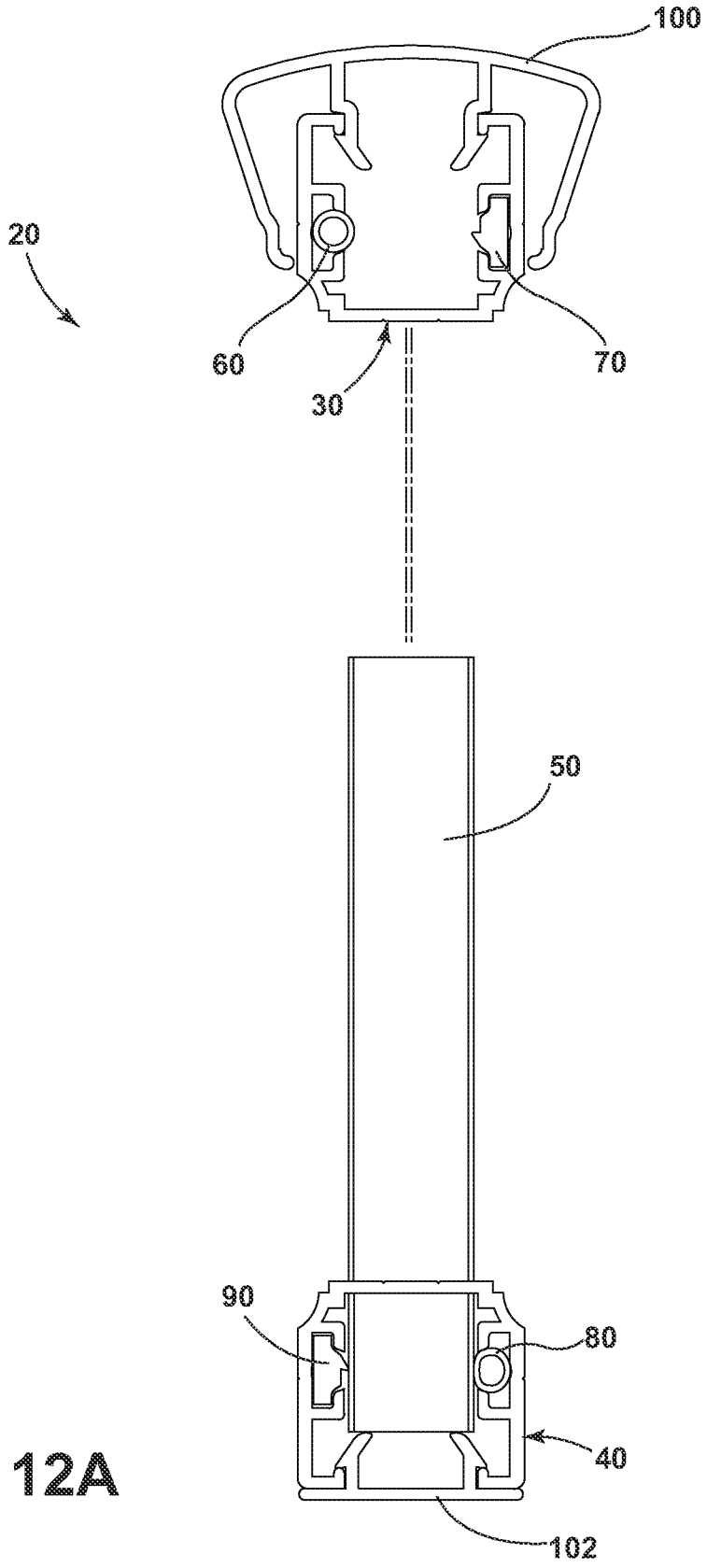
FIGS. 12A and 12B are exploded cross-sectional views of embodiments of a friction picket system in accordance with teachings of the present disclosure.
Figure 12B:
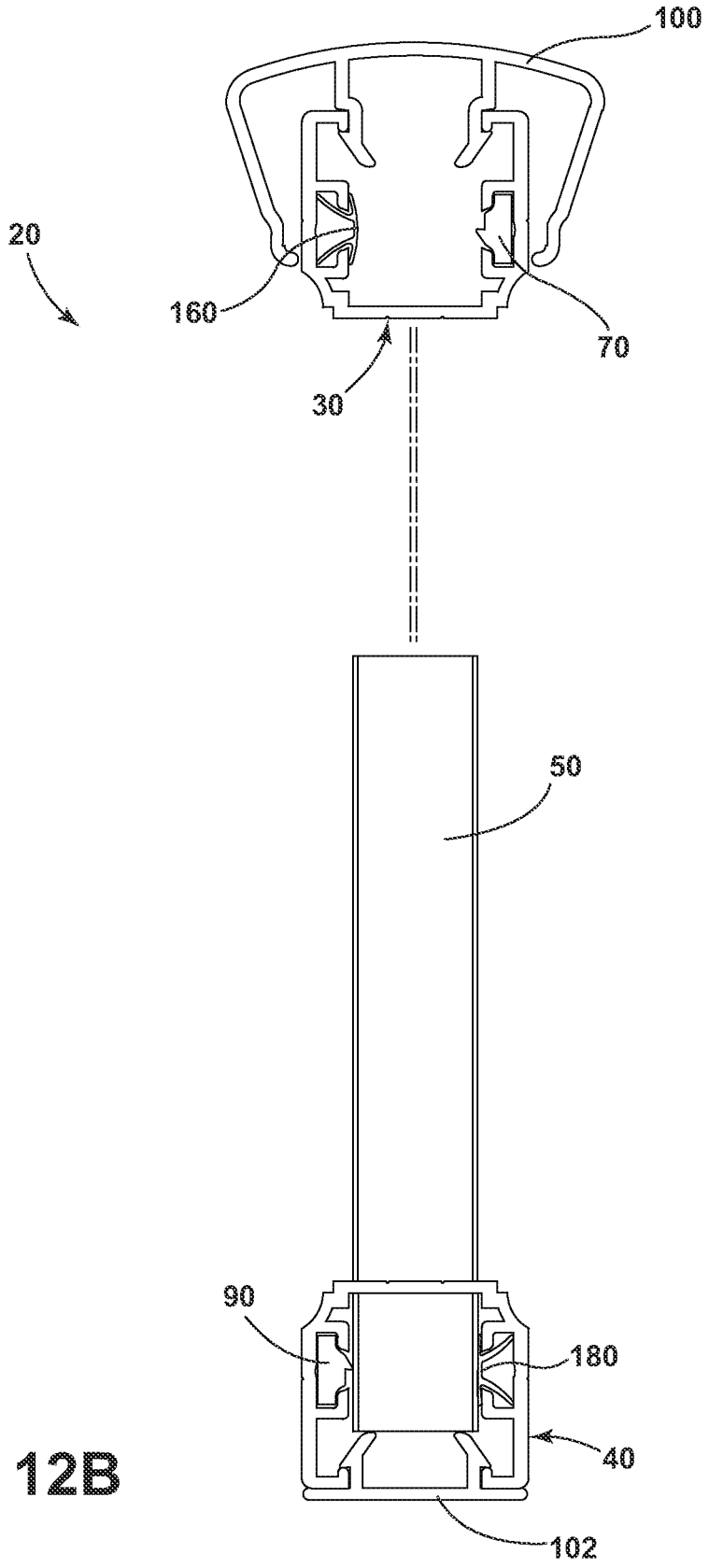
Figure 13A:
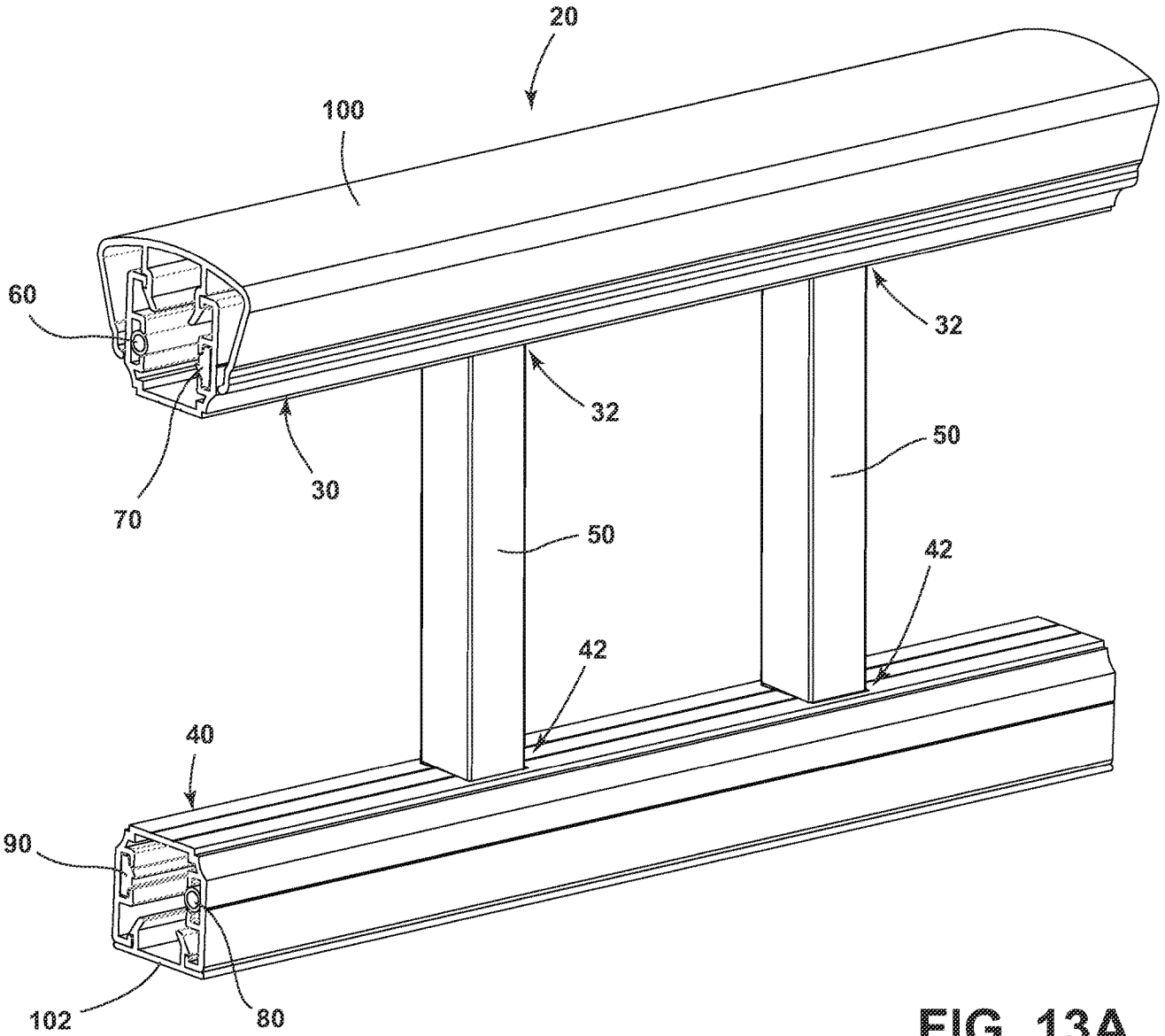
FIGS. 13A-15B are perspective views generally illustrating portions of embodiments of a friction picket system in accordance with teachings of the present disclosure.
Figure 13B:
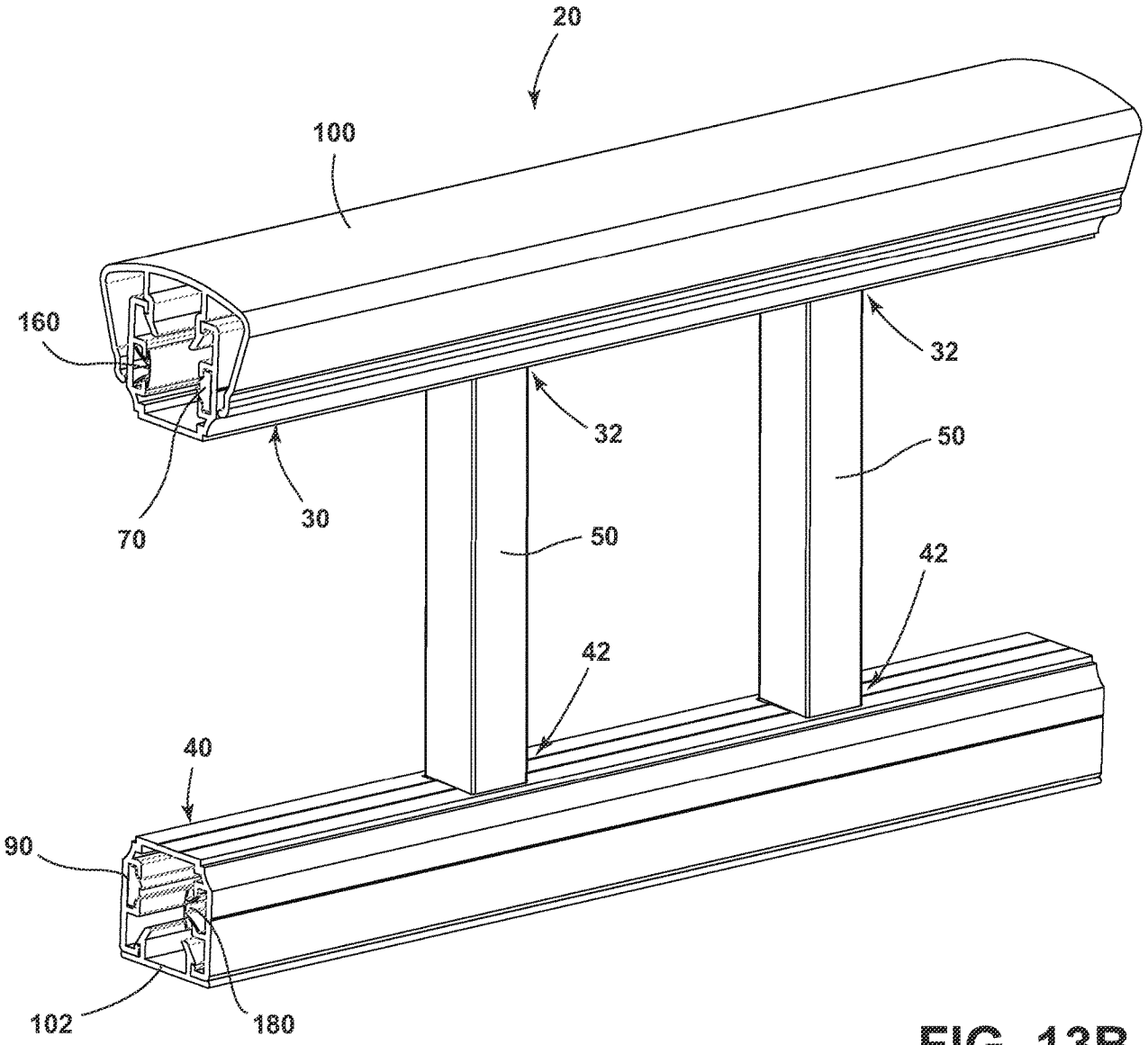
Figure 14A:
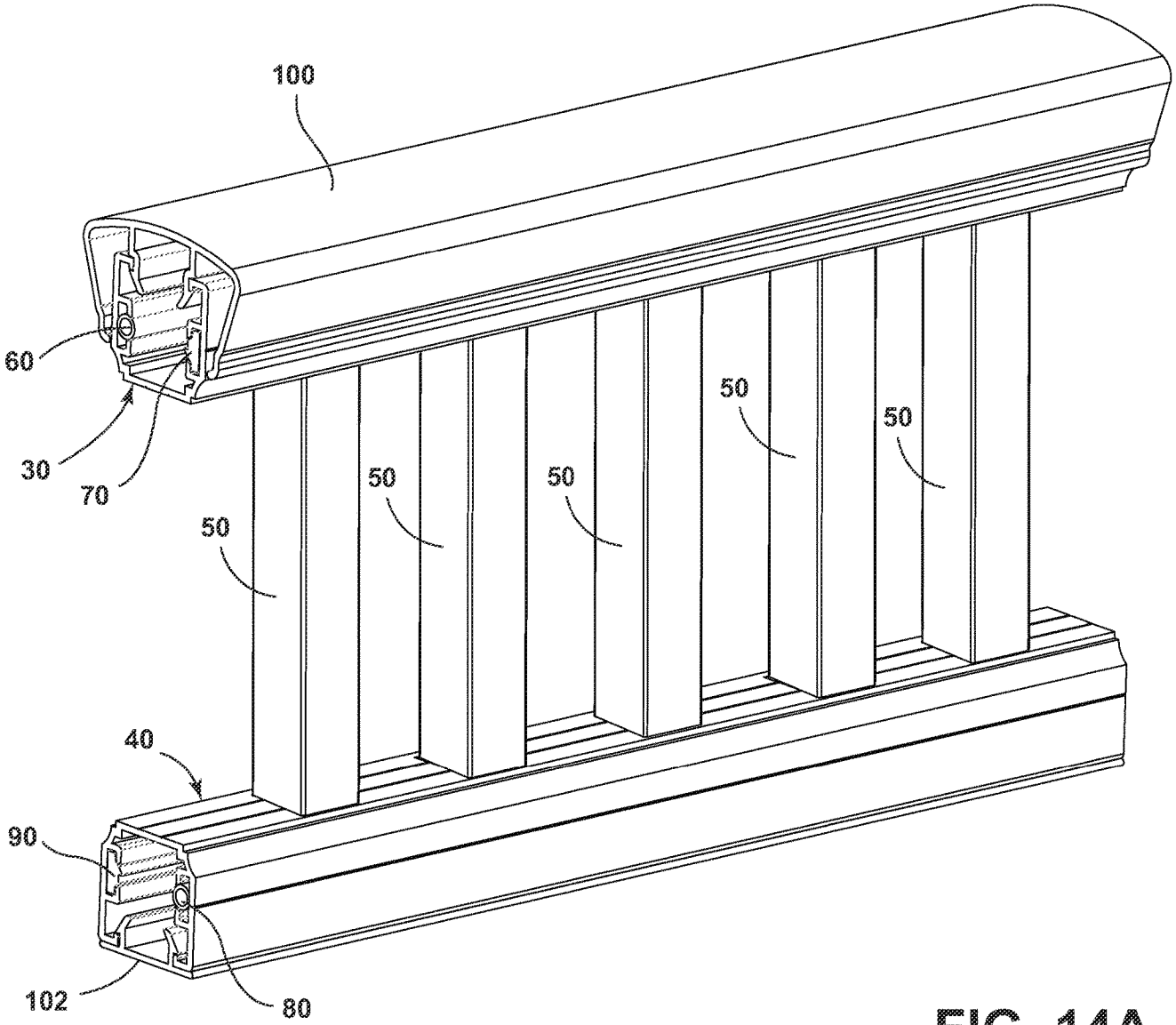
Figure 14B:
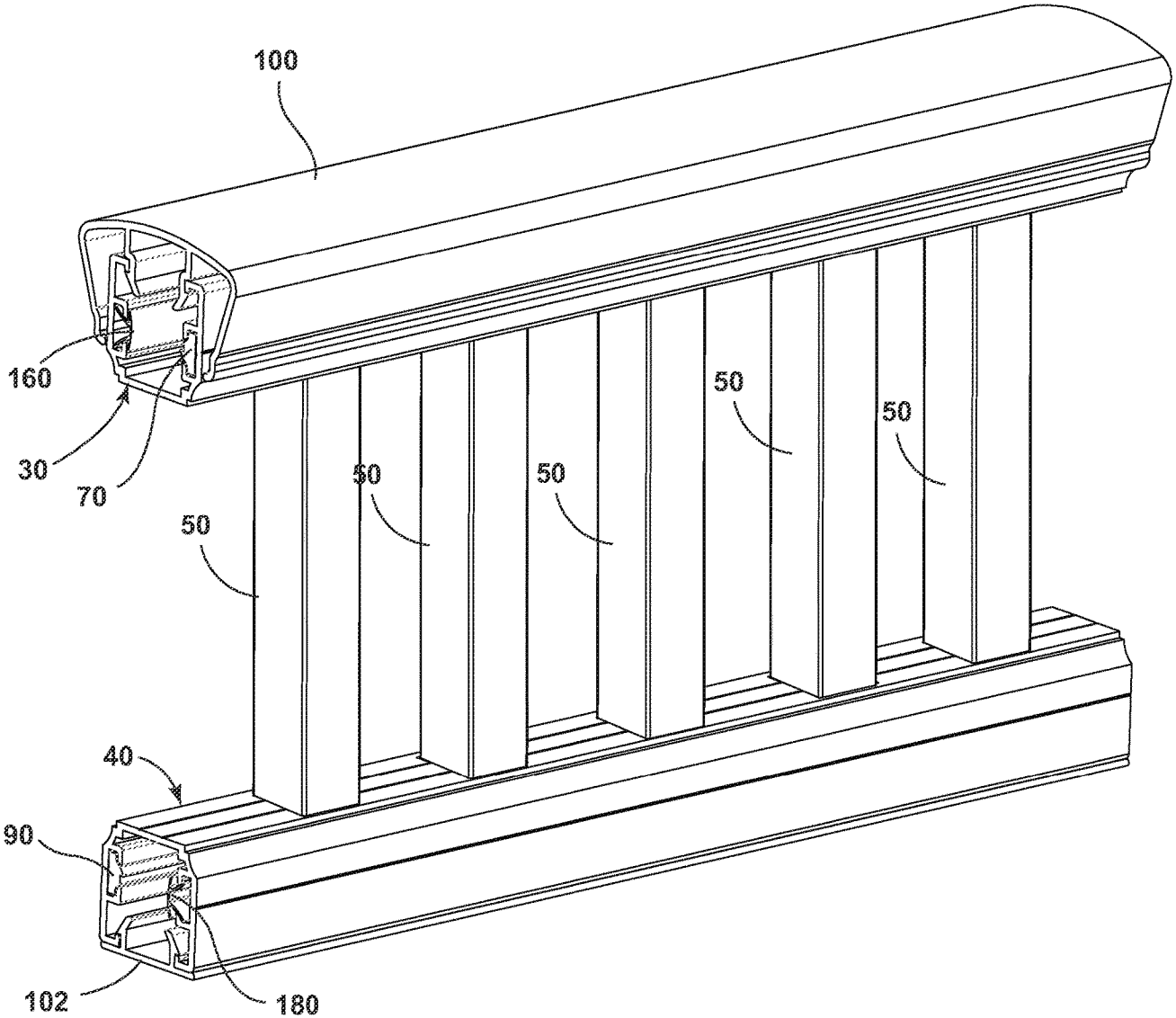
Figure 15A:
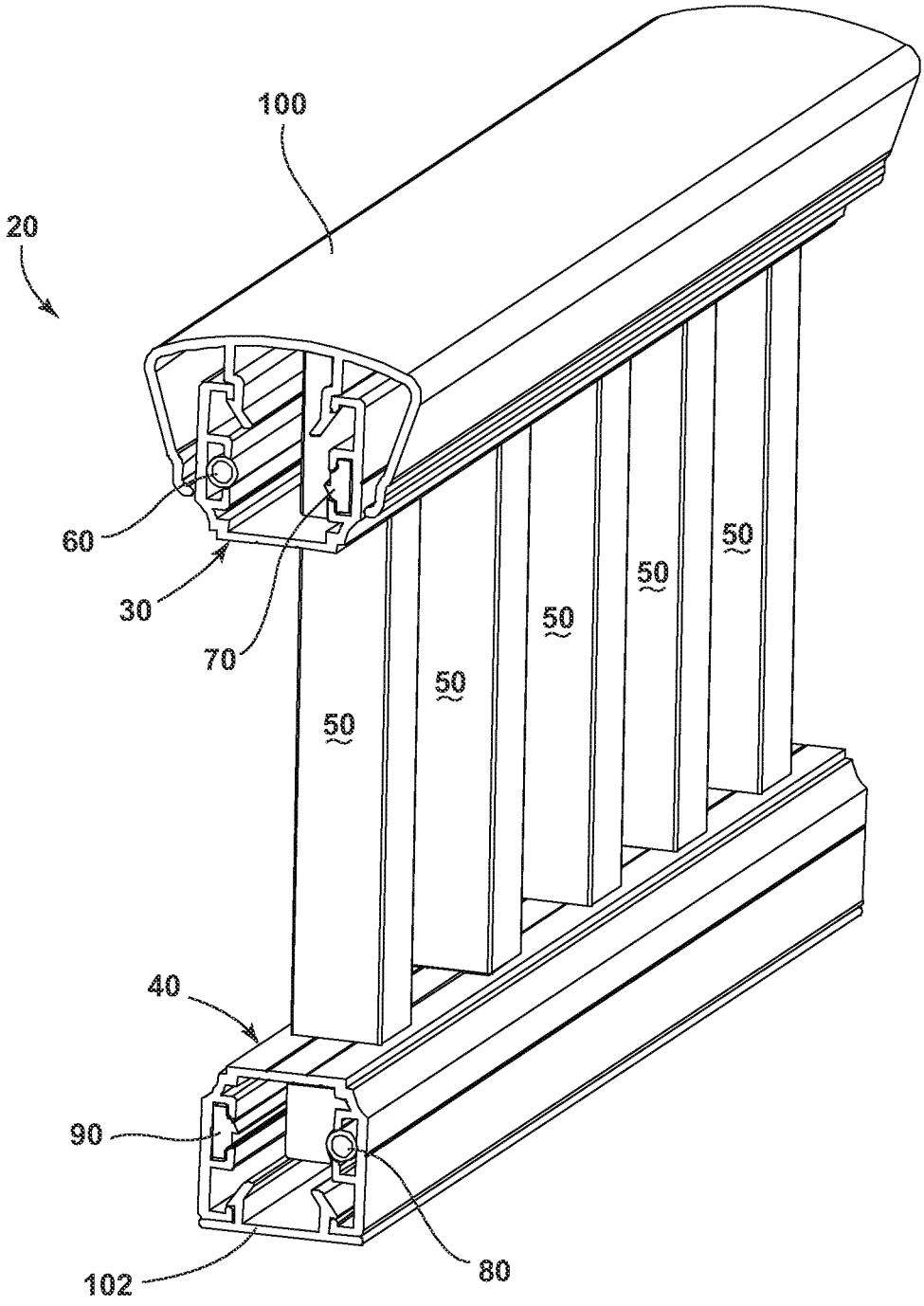
Figure 15B:
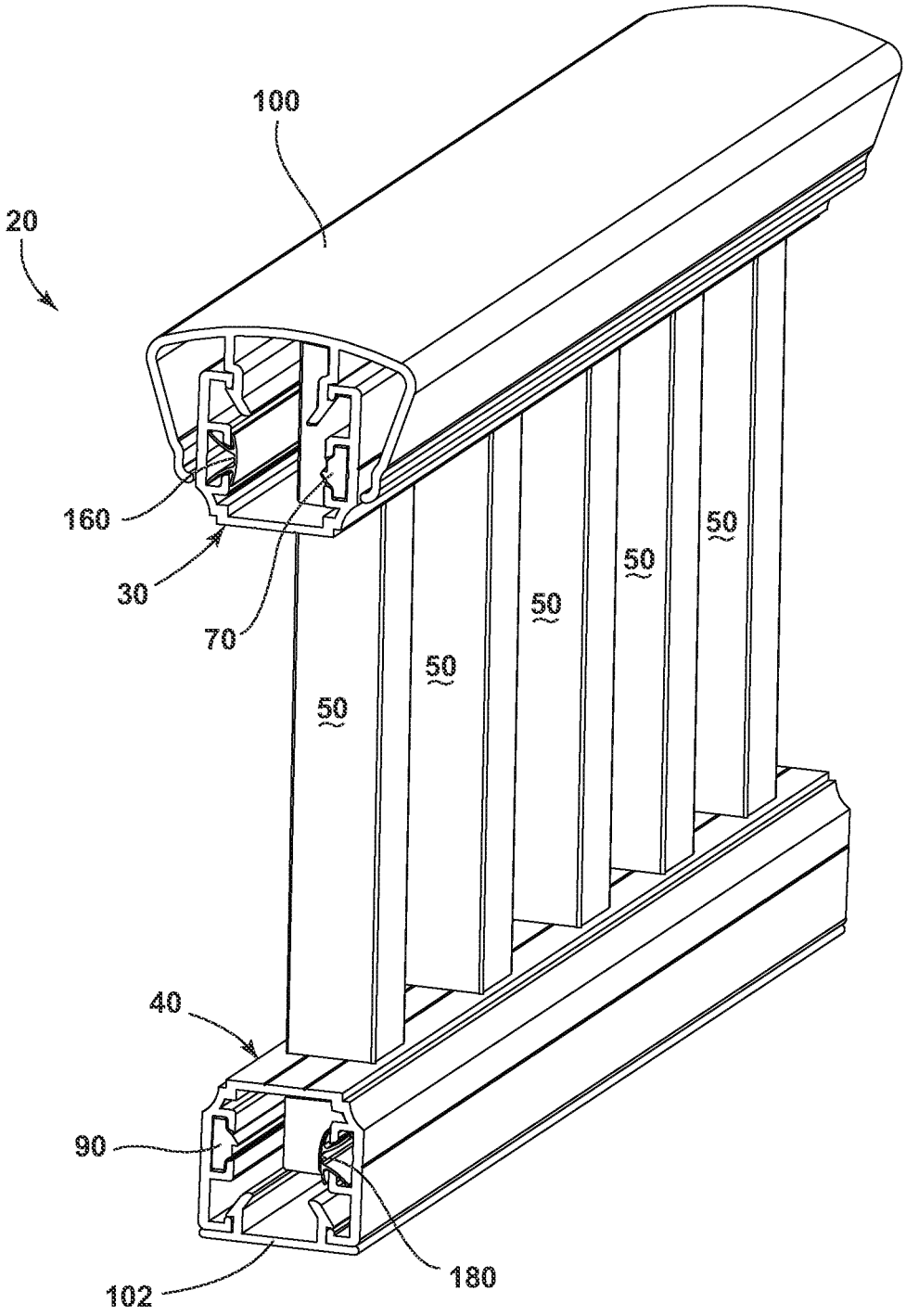
Figure 16A:
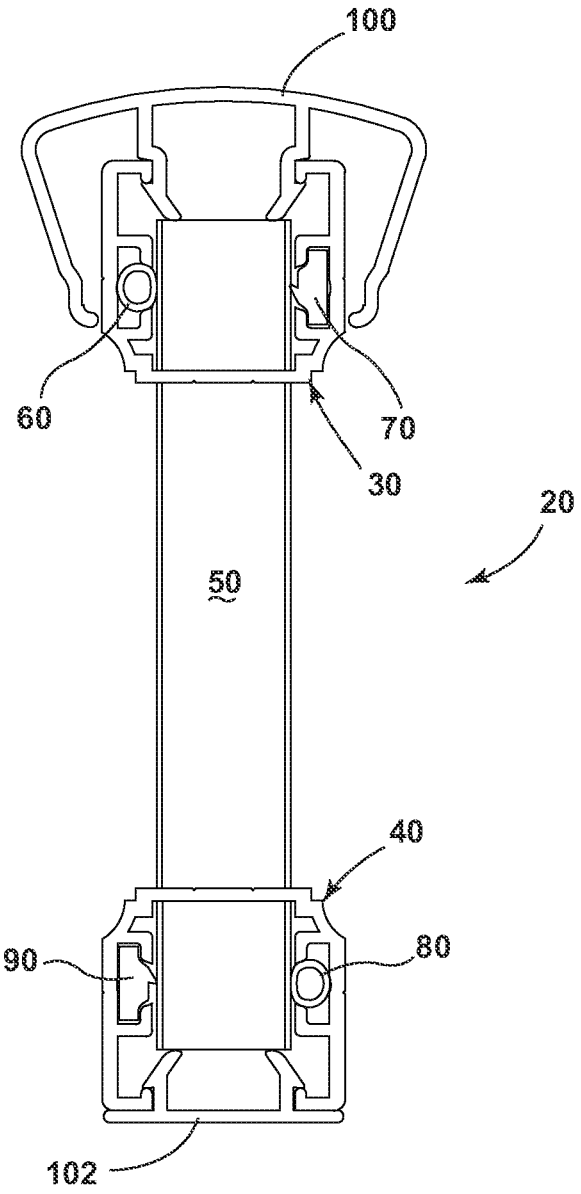
FIGS. 16A and 16B are cross-sectional views of embodiments of a friction picket system in accordance with teachings of the present disclosure.
Figure 16B:
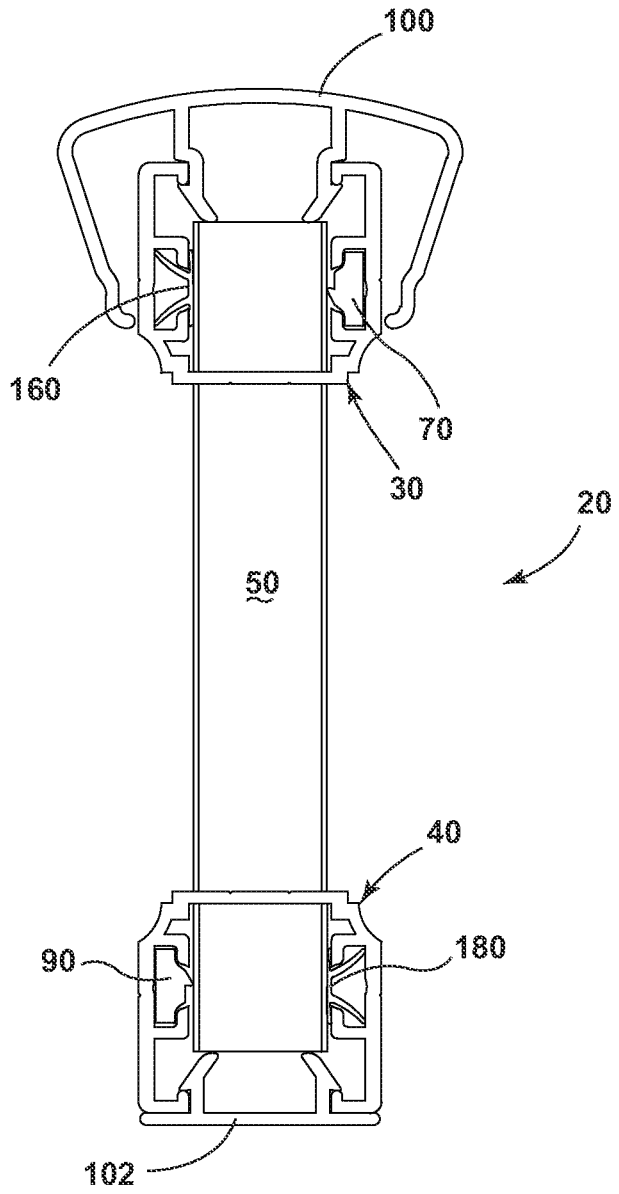
Figure 17A:
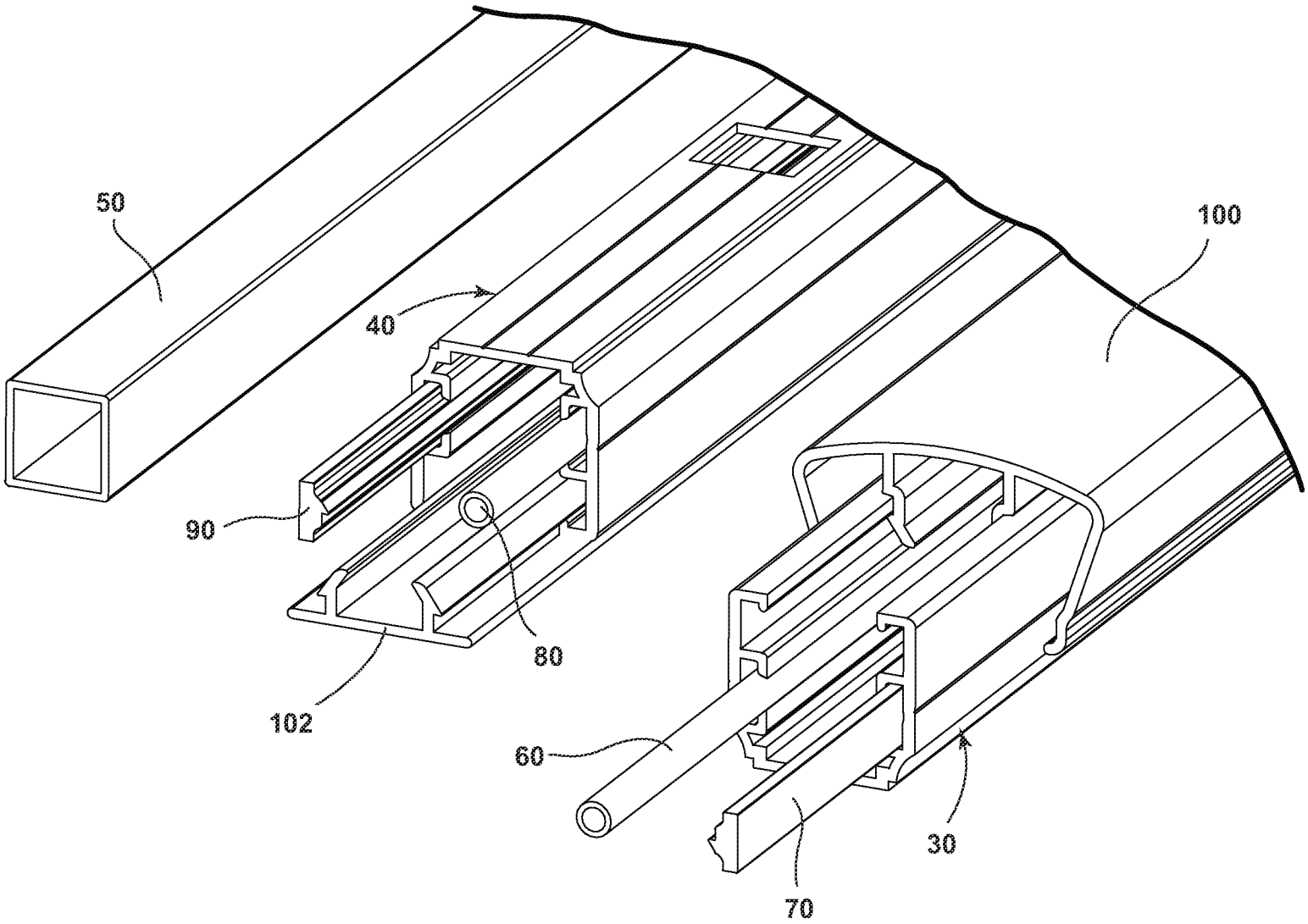
FIGS. 17A and 17B are exploded perspective views generally illustrating portions of embodiments of a friction picket systems in accordance with teachings of the present disclosure.
Figure 17B:
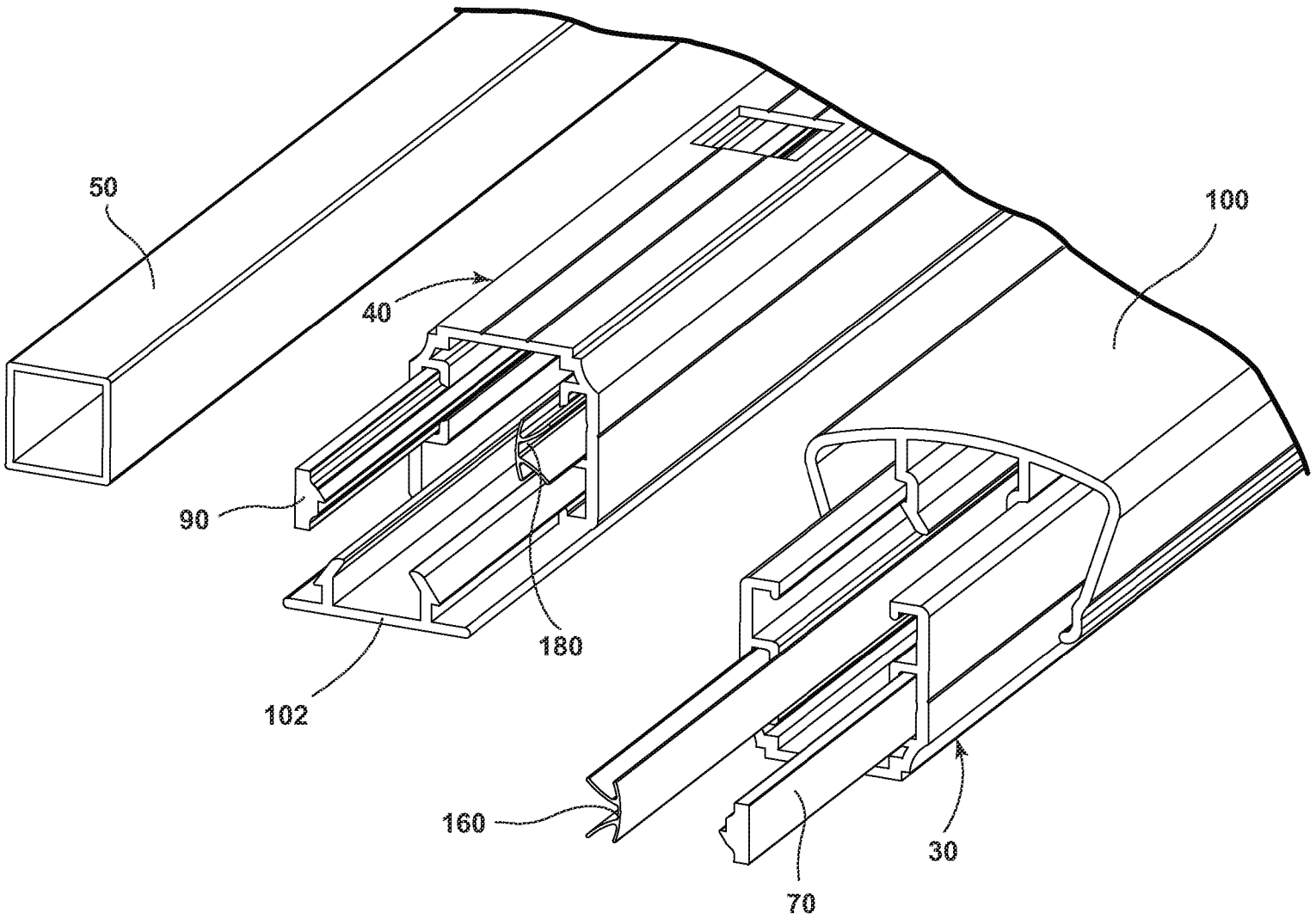
Figure 18A:
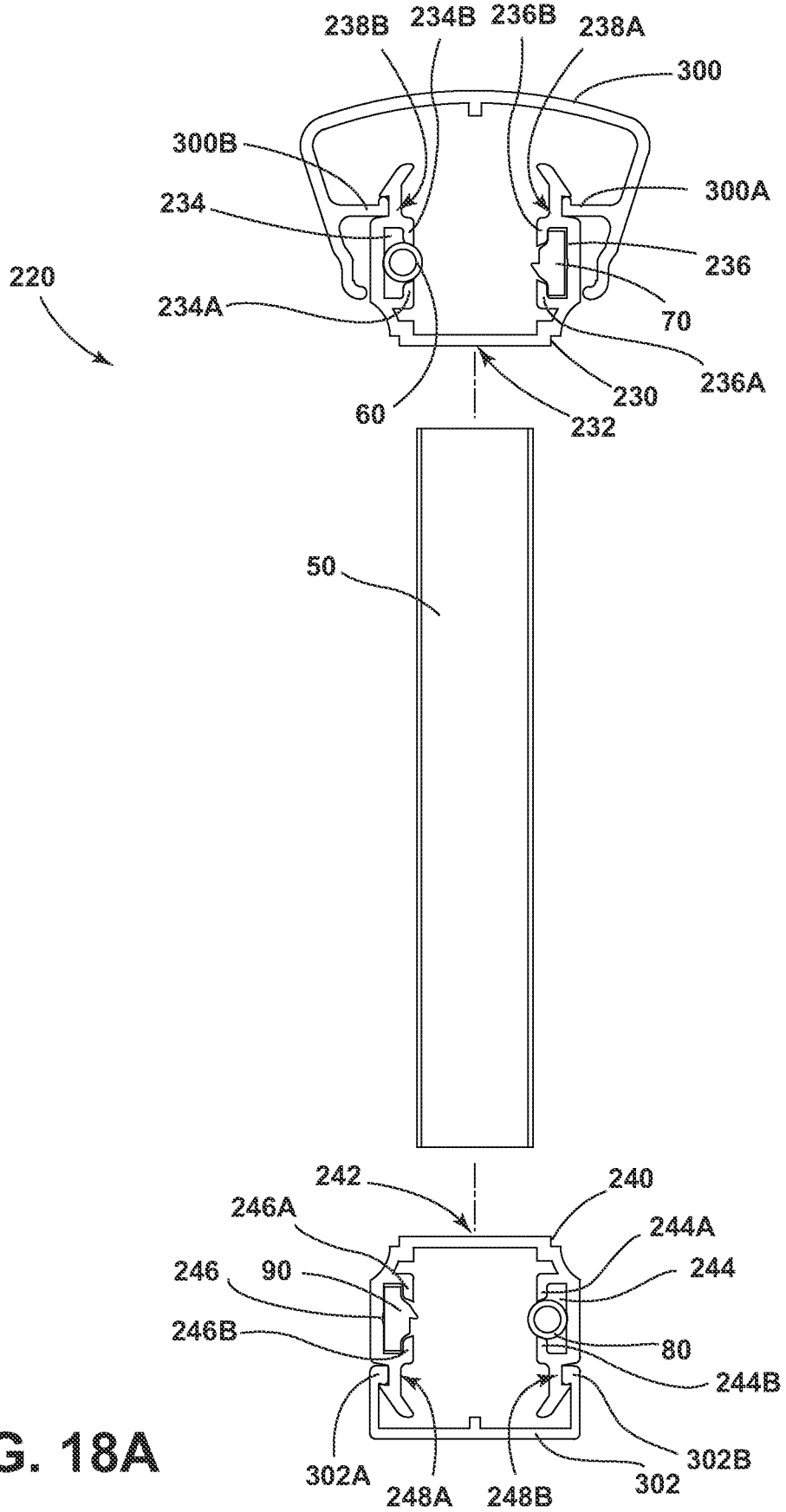
FIGS. 18A and 18B are cross-sectional views of embodiments of a friction picket system in accordance with teachings of the present disclosure.
Figure 18B:
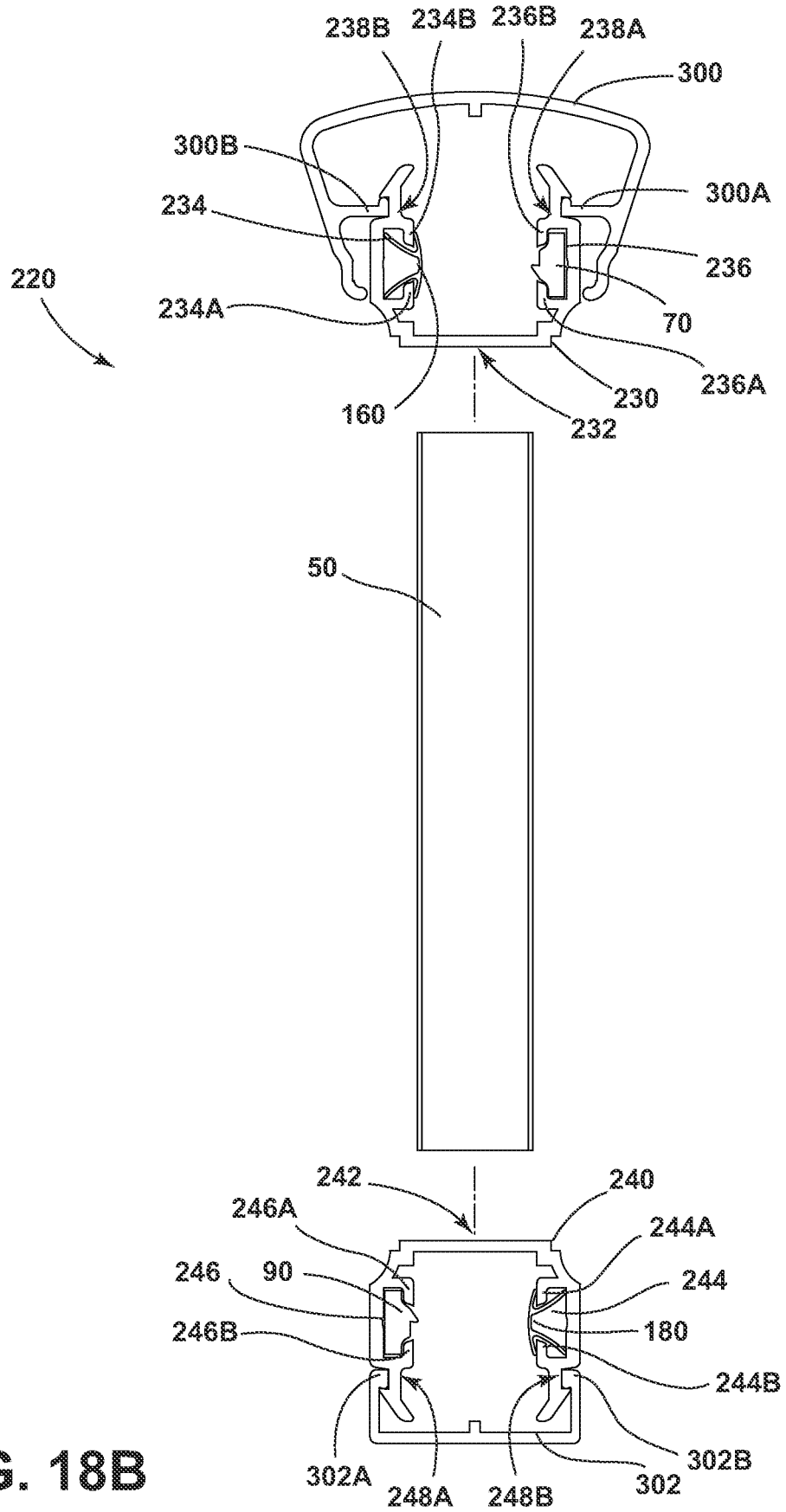
Figure 19A:
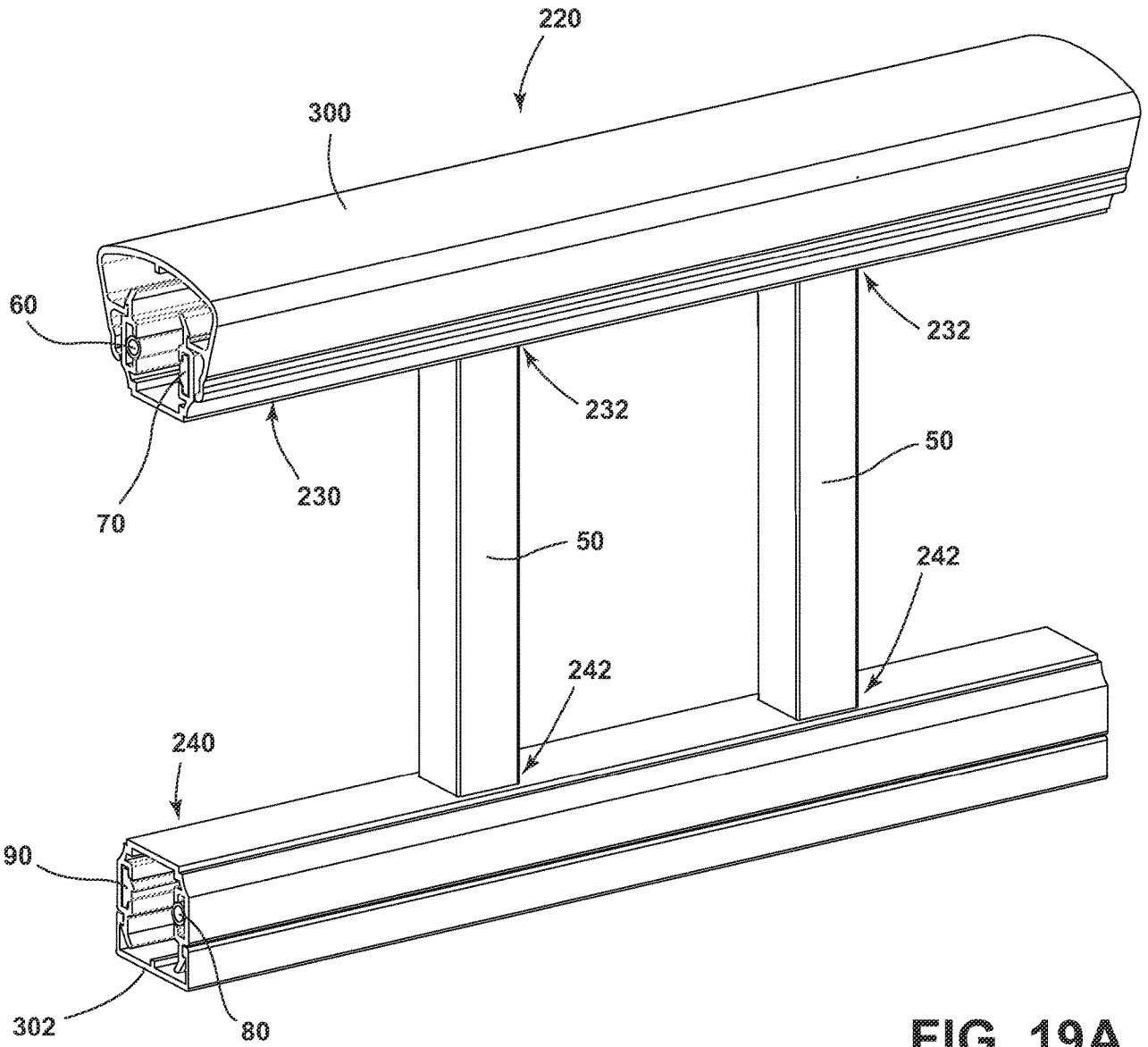
FIGS. 19A and 19B are exploded perspective views generally illustrating portions of embodiments of a friction picket systems in accordance with teachings of the present disclosure.
Figure 19B:
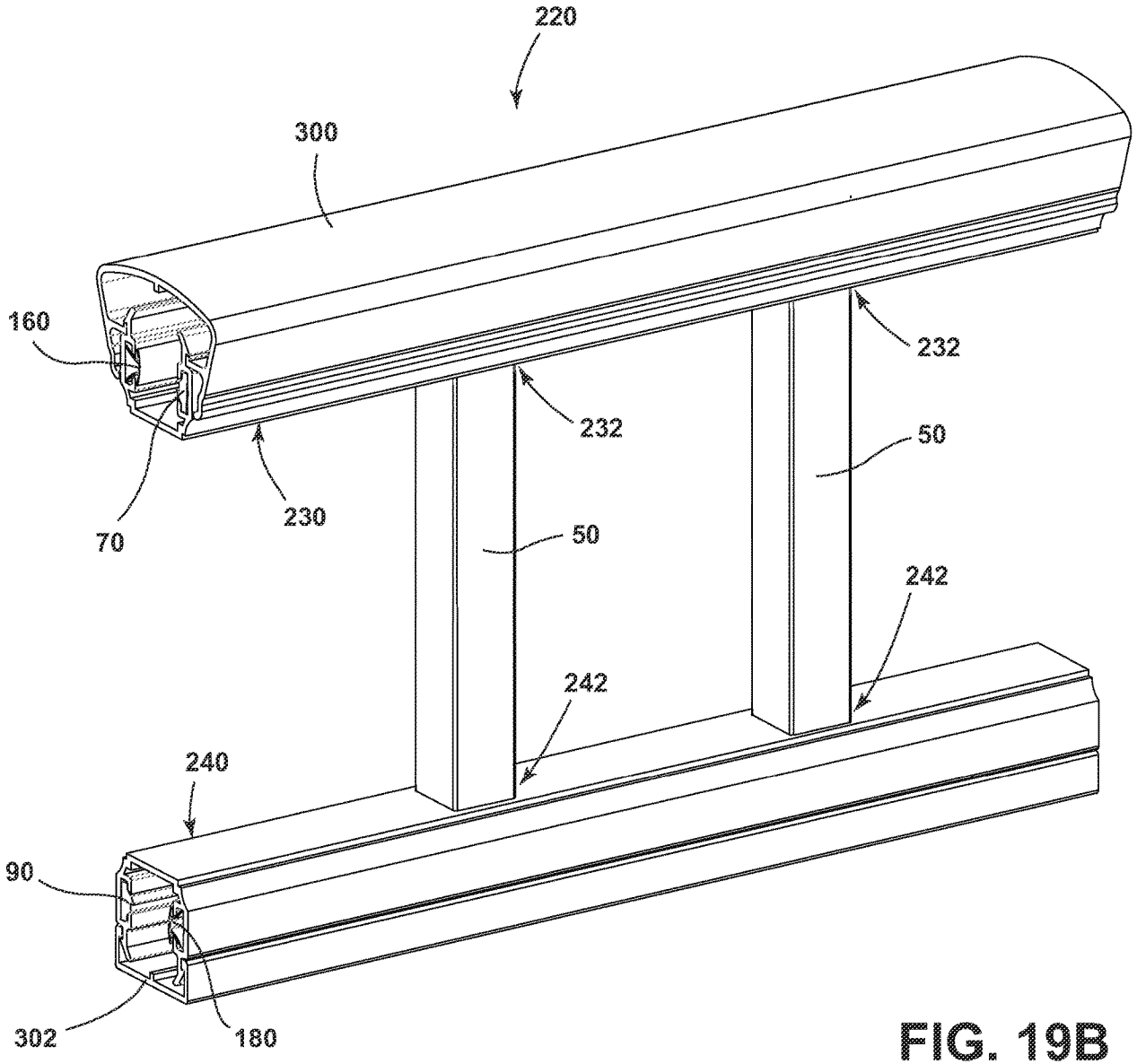
Figure 20A:
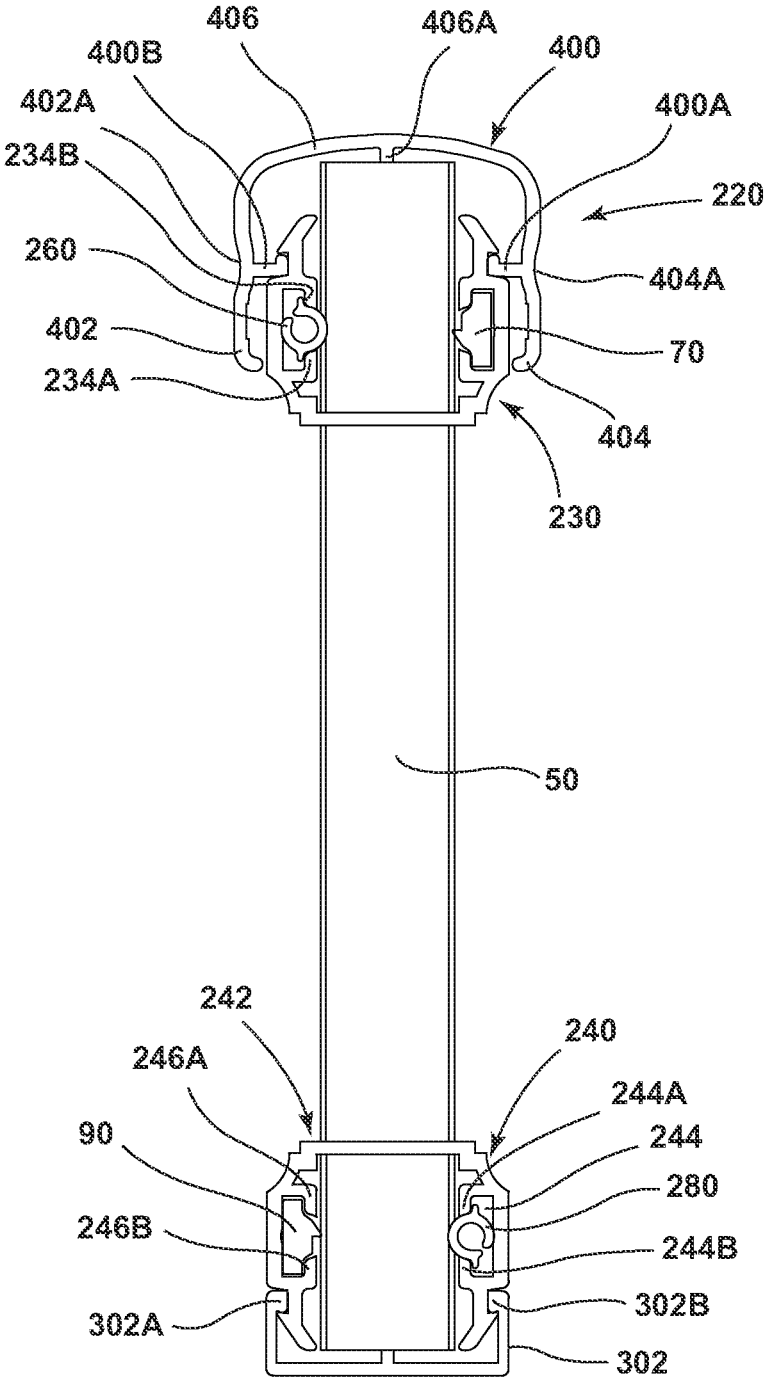
FIG. 20A is a cross-sectional view of an embodiment of a friction picket system in accordance with teachings of the present disclosure.
Figure 20B:
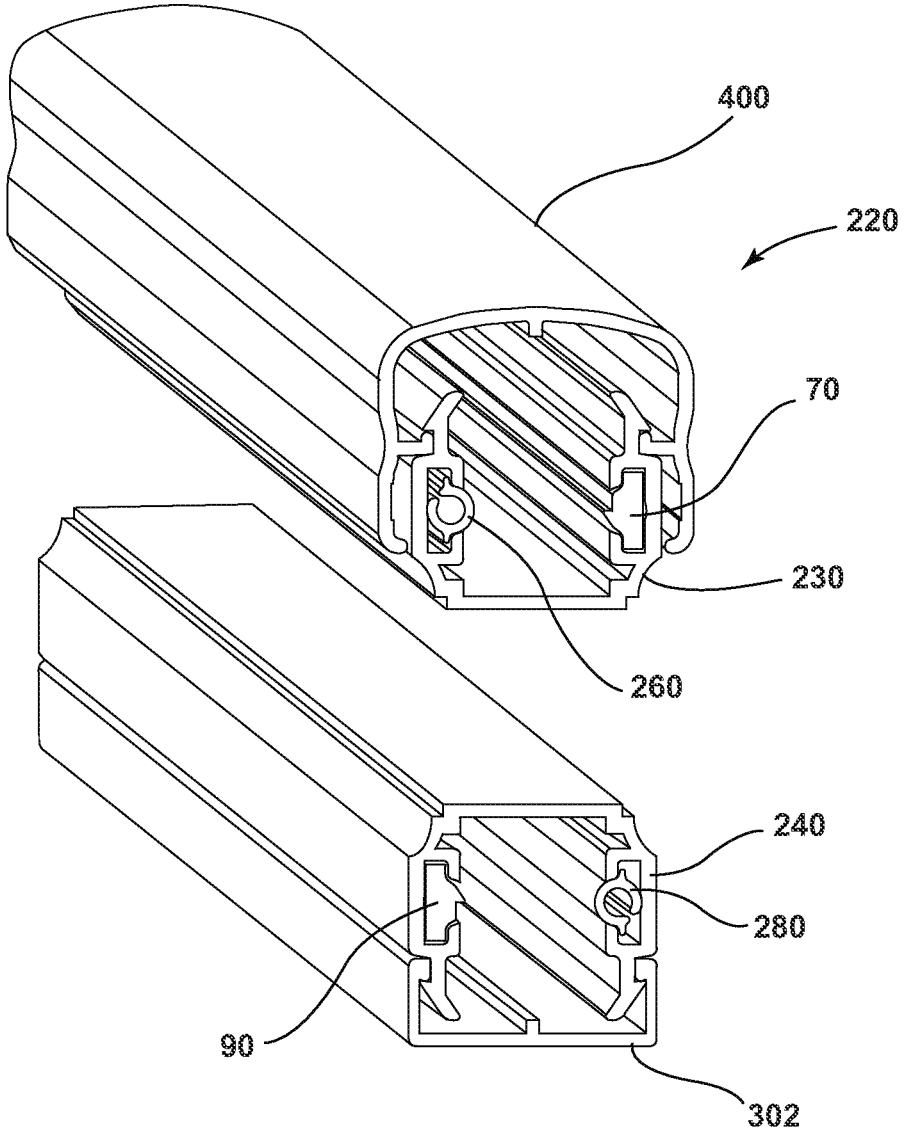
FIGS. 20B-20D are perspective views generally illustrating portions of embodiments of a friction picket system in accordance with teachings of the present disclosure.
Figure 20C:
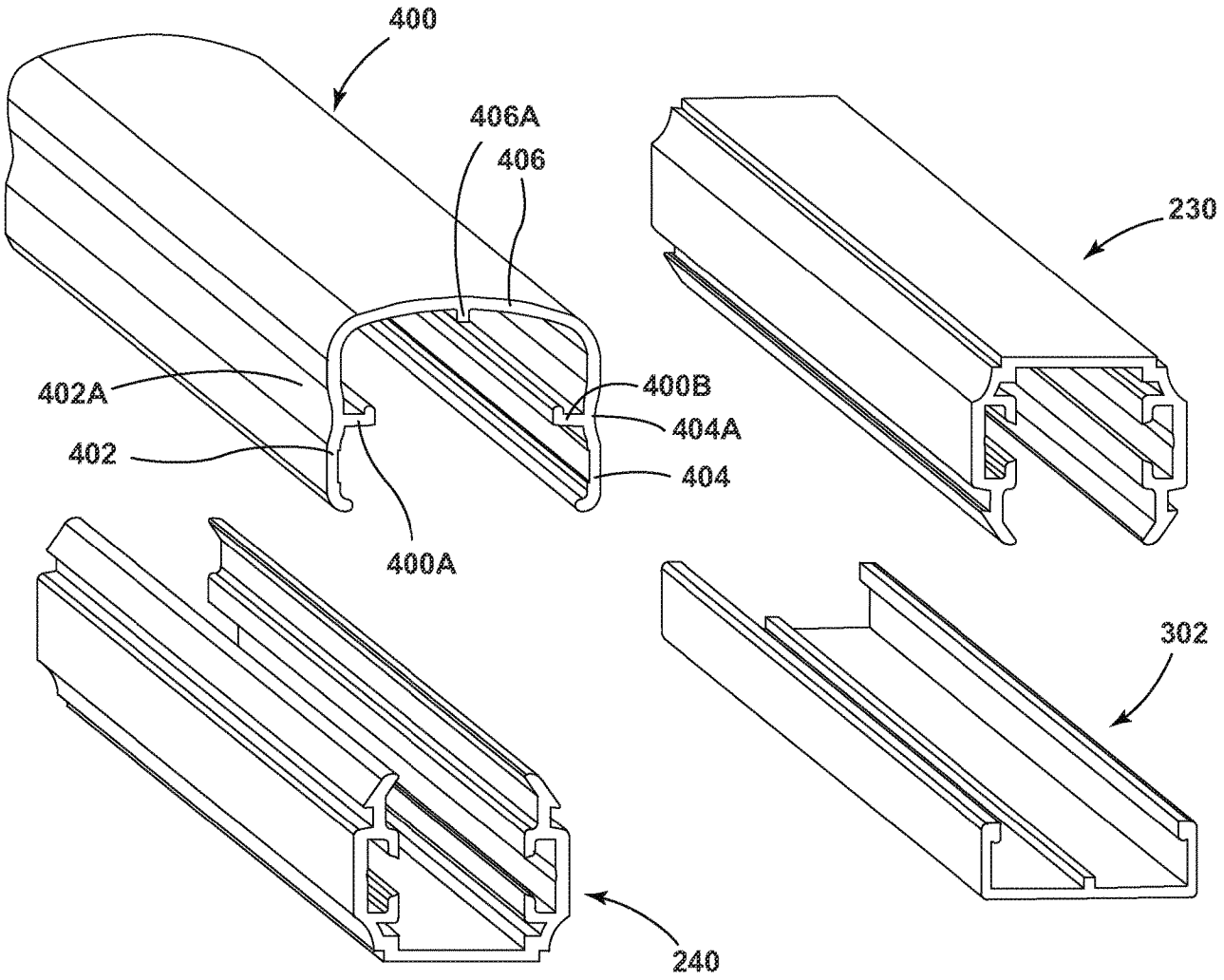
Figure 20D:
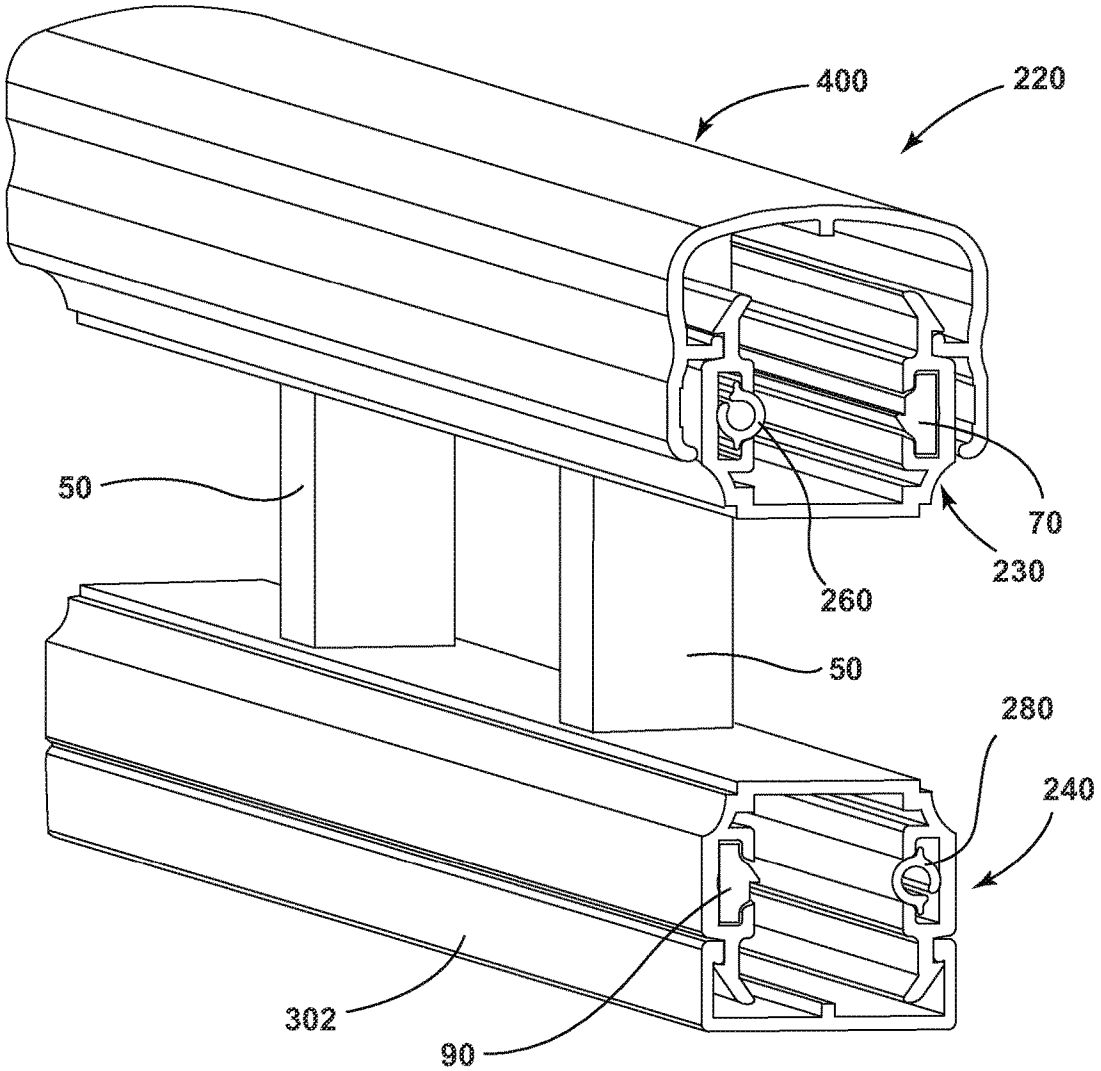
Figure 21A:
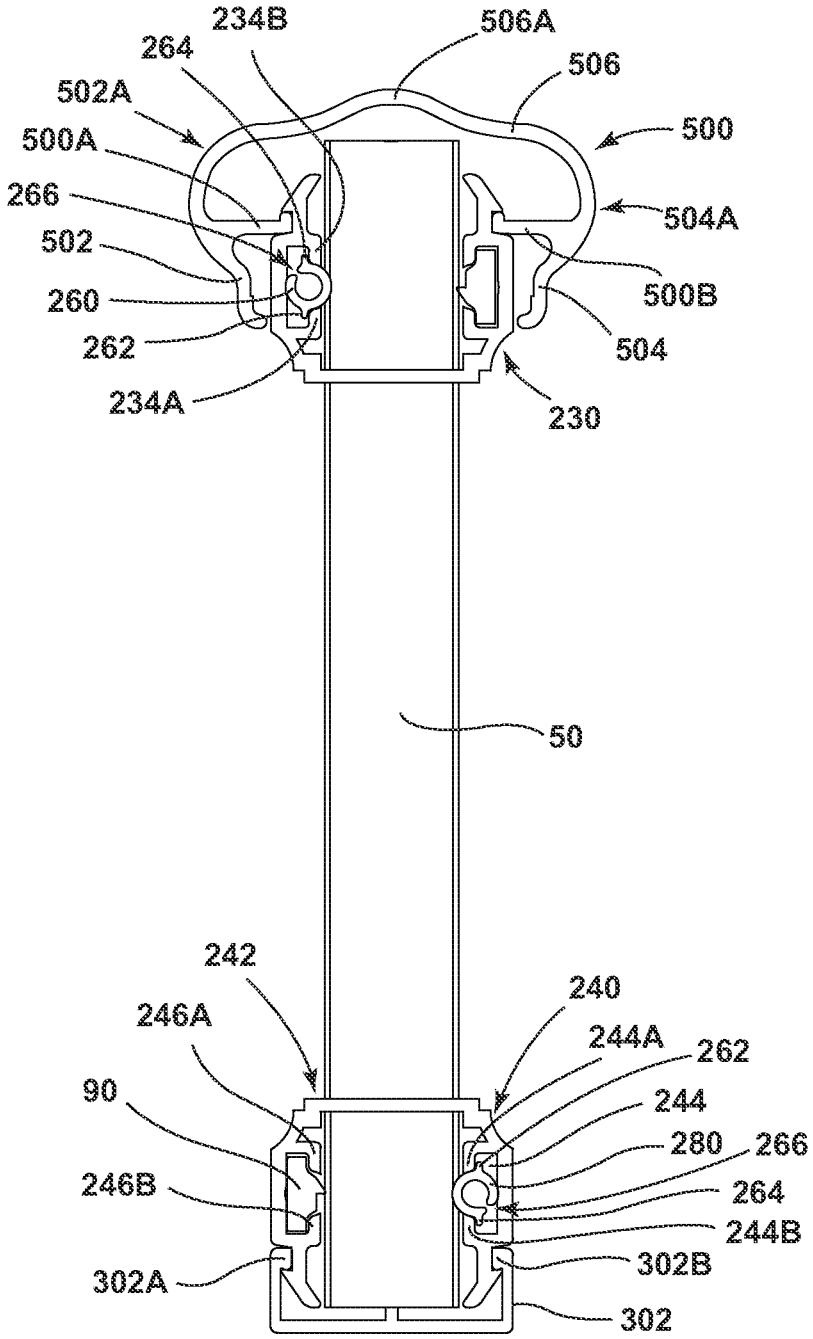
FIG. 21A is a cross-sectional view of an embodiment of a friction picket system in accordance with teachings of the present disclosure.
Figure 21B:
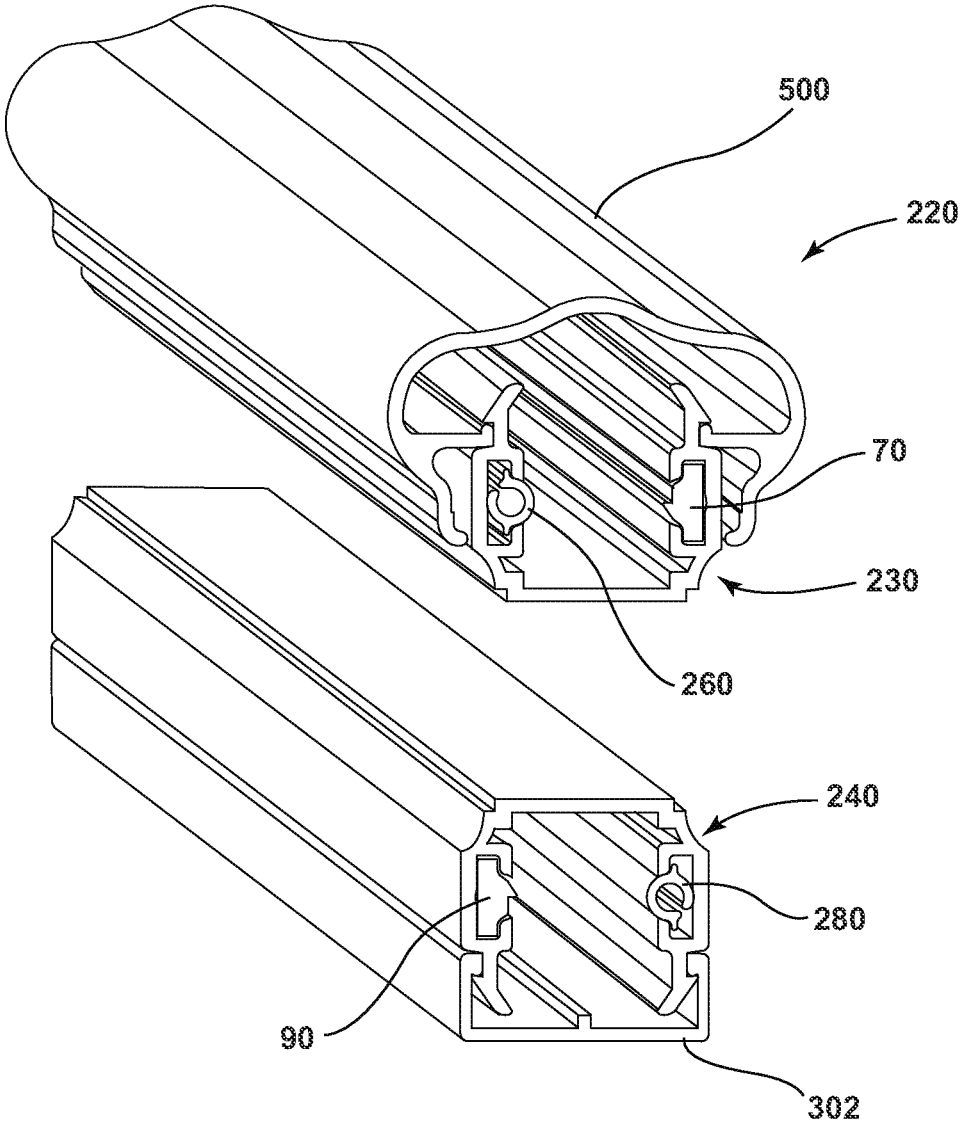
FIGS. 21B-21D are perspective views generally illustrating portions of embodiments of a friction picket system in accordance with teachings of the present disclosure.
Figure 21C:
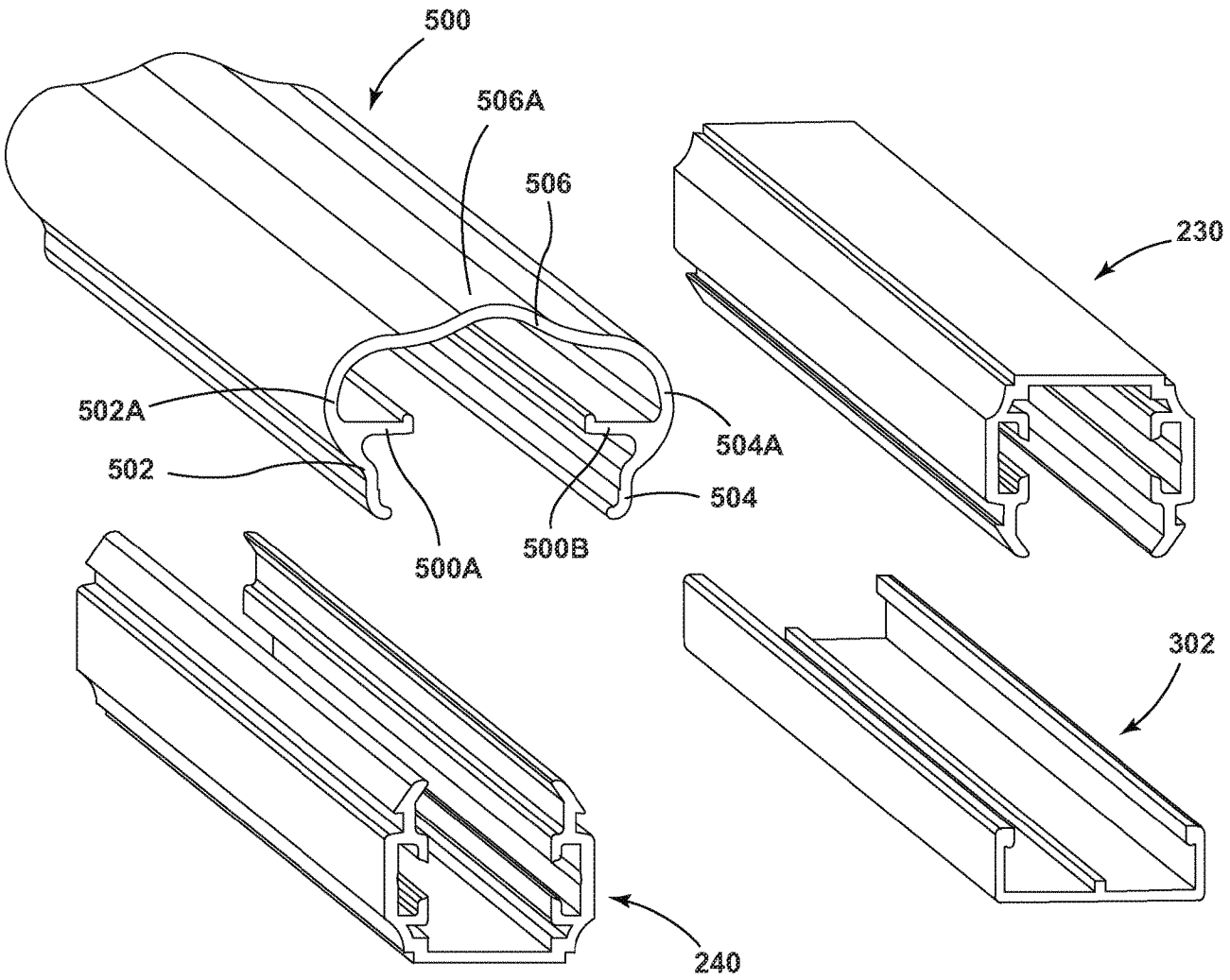
Figure 21D:
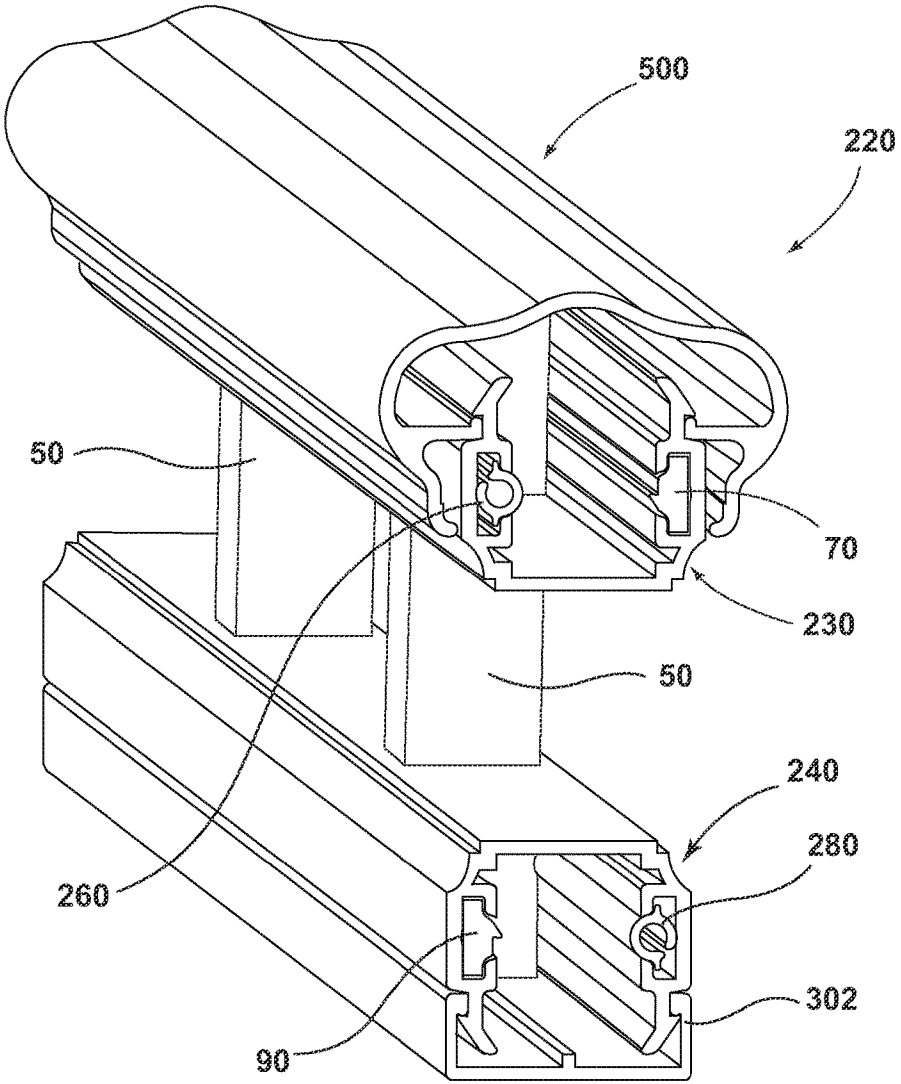

In embodiments, such as generally illustrated in FIGS. 7A-17B, a railing assembly 20 may be at least partially assembled and then shipped in an assembled or partially assembled state. For example, assembling railing assembly 20 may include a first railing portion 30 and/or a second railing portion 40 being formed and then apertures 32, 42 being formed/stamped into first railing portion 30 and/or second railing portion 40 according to a desired configuration of balusters 50 (e.g., number, spacing, residential/commercial building code requirements, size, shape, etc.). Once apertures 32, 42 have been stamped, first retaining elements (e.g., elements 60, 160, 260, 80, 180, 280) may be inserted into channels 34, 44 and/or pressure inserts 70, 90 may be inserted into channels 36, 46 (see, e.g., FIGS. 7A-8B). In embodiments, first retaining elements 60, 160, 260, 80, 180, 280 and/or pressure inserts 70, 90 (and/or corresponding channels 34, 44, 36, 46) may run along the entire length of first railing portion 30 and/or second railing portion 40. As generally illustrated in FIGS. 9A and 9B, a top cover 100 may be coupled (e.g., snapped) to one of first railing portion 30 and second railing portion 40, and a bottom cover 102 may be coupled to the other of first railing portion 30 and second railing portion 40 (e.g., via sliding and/or snapping).

In embodiments, such as generally illustrated in FIGS. 10A-16B, further assembly may be conducted in the field (e.g., at an installation location, such as at or near a customer's stairway). Second railing portion 40 may be disposed on a generally flat/horizontal surface and one or more balusters 50 may be inserted (e.g., one by one, or multiple at one time) into corresponding apertures 42 in second railing portion 40 (see, e.g., FIGS. 10A-11B). Then, first railing portion 30 may be disposed over each baluster 50 (see, e.g., FIGS. 12A and 12B) and pressed down (and/or second railing portion 40 may be pressed up) until each baluster 50 is properly seated in a corresponding aperture 32 (e.g., to form a completed railing assembly 20, such as generally illustrated in FIGS. 13A-16B).

In embodiments, insertion of a baluster 50 into a corresponding aperture 32, 42 may include a first retaining element (e.g., one or more of elements 60, 160, 260, 80, 180, 280) and a pressure insert 70, 90 applying opposing forces to the baluster 50 (e.g., retaining forces that may result from and/or increase friction between the baluster 50 and the first retaining element 60, 160, 260, 80, 180, 280 and/or pressure insert 70, 90). First retaining elements 60, 160, 260, 80, 180, 280 may be configured to bias and/or apply a force to the baluster 50 in a direction of the pressure inserts 70, 90. Additionally or alternatively, first retaining elements 60, 160, 260, 80, 180, 280 may be sufficiently flexible to allow an inserted baluster 50 to rotate to a desired stair angle (e.g., from an initial angle of 0 degrees, relative to vertical, to a desired stair angle that may be between 0 degrees and 40 degrees).

Embodiments of the present disclosure may include one of more of a variety of advantages. For example, and without limitation, railing assemblies 20 may be shipped with an assembled first railing portion 30 (e.g., with a top cover 100, retaining element 60, 160, or 260 and/or pressure insert 70), an assembled second railing portion 40 (e.g., with a bottom cover 102, retaining element 80, 180, or 280 and/or pressure insert 90), and one or more balusters 50. Initially (e.g., during shipping, upon delivery, etc.), the assembled first railing portion 30, the assembled second railing portion 40, and the one or more balusters 50 may not be assembled or operatively connected to each other (see, e.g., FIGS. 17A and 17B). Such a shipping arrangement may allow for smaller packaging relative to, for example, shipping a completed railing assembly 20, which may include balusters 50 inserted into both the first railing portion 30 and the second railing portion 40.

In embodiments, an assembled first railing portion 30, an assembled second railing portion 40, and one or more balusters 50 may be assembled together relatively quickly in the field. For example, and without limitation, balusters 50 may be inserted into and retained by first and second railing portions 30, 40 without any tools or fasteners because the retaining force provided by the first retaining elements (e.g., elements 60 and 80, elements 160 and 180, or elements 260 and 280) and/or pressure inserts 70, 90 may be sufficient to hold balusters 50 in place. Additionally or alternatively, elongated apertures 32, 42 may allow for all of the balusters 50 to be inserted into a second railing portion 40 and/or a first railing portion 30 without regard for the angle of assembly (e.g., the stair angle). In embodiments, once the balusters 50 have been inserted into the first railing portion 30, the railing assembly 20 may be angled to match the stair angle without individual adjustment of the balusters 50, the first railing portion 30, or the second railing portion 40.

In embodiments, such as generally illustrated in FIGS. 18A, 18B, 19A, and 19B, a railing assembly 220 may include a top cover 300 that may be decorative and/or configured for a user to hold, such as when using stairs. Top cover 300 may be connected (e.g., coupled and/or snapped) to a railing portion (e.g., first railing portion 230). In embodiments, top cover 300 may be disposed about a railing portion such that it covers some or all of the railing portion. Top cover 300 may be connected externally to the railing portion. For example, and without limitation, top cover 300 may include protrusions 300A, 300B that may extend toward the railing portion (e.g., horizontally) and/or may be configured to engage with external recesses of the railing portion (e.g., recesses 238A, 238B of first railing portion 230). Additionally or alternatively, a railing assembly 220 may include a bottom cover 302 that may be coupled and/or snapped to a railing portion (e.g., second railing portion 240). In embodiments, cover 302 may be connected with the railing portion externally. For example, and without limitation, bottom cover 302 may include flanges 302A, 302B that may extend toward the railing portion (e.g., vertically) and/or may be configured to engage with external recesses of the railing portion (e.g., recesses 248A, 248B of second railing portion 240).

In embodiments, first railing portion 230 may include one or more apertures 232, a channel 234 (e.g., a generally horizontal channel), which may be defined by protrusions 234A, 234B, and/or a channel 236, which may be defined by protrusion 236A, 236B. Channel 234 may be configured to receive first retaining elements 60, 80, 160, 180, 260, and/or 280. Channel 236 may be configured to receive second retaining elements 70 and/or 90. In embodiments, channels 234, 236 may include the same or similar configurations and may both be configured to receive first retaining elements 60, 80, 160, 180, 260, 280 and/or second retaining elements 70, 90.

In embodiments, second railing portion 240 may include one or more apertures 242, a channel 244 (e.g., a generally horizontal channel), which may be defined by protrusions 244A, 244B, and/or a channel 246, which may be defined by protrusion 246A, 246B. Channel 244 may be configured to receive first retaining elements 60, 80, 160, 180, 260, and/or 280. Channel 246 may be configured to receive second retaining elements 70 and/or 90. In embodiments, channels 244, 246 may include the same or similar configurations and may both be configured to receive first retaining elements 60, 80, 160, 180, 260, 280 and/or second retaining elements 70, 90.

In embodiments, first railing portion 30 may be configured the same or substantially similarly to second railing portion 40. In an assembled configuration, first railing portion 30 and second railing portion 40 may be disposed in a generally mirrored configuration. In embodiments, first railing portion 230 may be configured the same or substantially similarly to second railing portion 240. In an assembled configuration, first railing portion 230 and second railing portion 240 may be disposed in a generally mirrored configuration.

In embodiments, such as generally illustrated in FIGS. 20A, 20B, 20C, and 20D, railing assembly 220 may include a top cover 400 that may be decorative and/or configured for a user to hold, such as when using stairs. Top cover 400 may be connected (e.g., coupled and/or snapped) to a railing portion (e.g., first railing portion 230). In embodiments, top cover 400 may be disposed about a railing portion (e.g., first railing portion 230) such that it covers some or all of the railing portion. Top cover 400 may be connected externally to the railing portion. For example, and without limitation, top cover 400 may include protrusions 400A, 400B that may extend toward the railing portion (e.g., horizontally) and/or may be configured to engage with external recesses of the railing portion (e.g., recesses 238A, 238B of first railing portion 230). Cover 400 may include a first side wall 402, a second side wall 404, and/or a third side wall 406. First side wall 402 and second wall 404 may be disposed opposite each other, may be configured to be disposed on opposite sides of a railing portion (e.g., first railing portion 230), and/or may be connected to each other via third side wall 406. First side wall 402 may be generally vertical, second side wall 404 may be generally vertical, and/or third side 406 wall may be generally horizontal. First side wall 402 and/or second side 404 wall may include a recess (e.g., recesses 402A, 404A). Recesses 402A, 404A may be configured to facilitate gripping of cover 400 and/or railing assembly 220 (e.g., by a user). Recesses 402A, 404A may be aligned with protrusions 400A, 400B, respectively, and/or protrusions 400A, 400B may extend inward from first side wall 402 and second side wall 404 at or about recesses 402A, 404A. In embodiments, third side wall 406 may include a protrusion 406A that may extend generally inward (e.g., between first side wall 402 and second side wall 404) and/or perpendicularly to third side wall 406. Protrusion 406A may be configured to contact a baluster 50 and/or limit an insertion depth of a baluster 50.

In embodiments, such as generally illustrated in FIGS. 21A, 21B, 21C, and 21D, railing assembly 220 may include a top cover 500 that may be decorative and/or configured for a user to hold, such as when using stairs. Top cover 500 may be connected (e.g., coupled and/or snapped) to a railing portion (e.g., first railing portion 230). In embodiments, top cover 500 may be disposed about a railing portion (e.g., first railing portion 230) such that it covers some or all of the railing portion. Top cover 500 may be connected externally to the railing portion. For example, and without limitation, top cover 500 may include protrusions 500A, 500B that may extend toward the railing portion (e.g., horizontally) and/or may be configured to engage with external recesses of the railing portion (e.g., recesses 238A, 238B of first railing portion 230). Cover 500 may include a first side wall 502, a second side wall 504, and/or a third side wall 506. First side wall 502 and second wall 504 may be disposed opposite each other, may be configured to be disposed on opposite sides of a railing portion (e.g., first railing portion 230), and/or may be connected to each other via third side wall 506. First side wall 502 may taper generally outward (e.g., away from axis 20A), second side wall 504 may taper generally outward, and/or third side wall 506 may be generally horizontal. First side wall 502 and/or second side wall 504 may include a curved portion (e.g., curved portions 502A, 504A). Curved portions 502A, 504A may be configured to facilitate gripping of cover 500 and/or railing assembly 220 (e.g., by a user). Curved portions 502A, 504A may be generally convex and/or may extend generally horizontally outward. Curved portions 502A, 504A be aligned with protrusions 500A, 500B, respectively and/or protrusions 500A, 500B may extend inward from first side wall 502 and second side wall 504 at or about curved portions 502A, 504A. In embodiments, third side wall 506 may include a curved portion 506A that may be disposed at or about the middle of third side wall 506. Curved portion 506A may be generally convex and/or may extend generally vertically upward. Curved portions 502A, 504A 506A of first, second, and third side walls 502, 504, 506 may provide cover 500 with a generally crown-shaped cross section.

It should be understood that references to a single element are not so limited and may include one or more of such element. It should also be understood that the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present teachings not be limited to the particular examples illustrated by the drawings and described in the specification as the best mode presently contemplated for carrying out the teachings of the present disclosure, but that the scope of the present disclosure will include any embodiments falling within the foregoing description and the appended claims.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "embodiments," "one embodiment," or "an embodiment," or the like, means that a particular feature, structure, or characteristic described in connection with the embodiment is included in at least one embodiment. Thus, appearances of the phrases "in various embodiments," "in embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional. Any directional references (e.g., plus, minus, upper, lower, upward, downward, left, right, leftward, rightward, top, bottom, above, below, vertical, horizontal, clockwise, and counterclockwise) are used for identification purposes to aid the reader's understanding of the present disclosure, and do not create limitations, particularly as to the position, orientation, or use of embodiments.

Although only certain embodiments have been described above with a certain degree of particularity, those skilled in the art could make numerous alterations to the disclosed embodiments without departing from the scope of this disclosure. Joinder references (e.g., attached, coupled, connected, and the like) are to be construed broadly and may include intermediate members between a connection of elements, relative movement between elements, and/or various types of connections. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

What is claimed is:

1. A fencing assembly, comprising:

a first rail having a first interior and provided with a first resilient retaining element defining a first surface;

a second rail having a second interior and provided with a second resilient retaining element defining a second surface; and a baluster having at least a portion with a continuous, solid, planar or linear outer surface wall, wherein the first surface of the first resilient retaining element and the second surface of the second resilient retaining element deflect away from, and frictionally engage with, the continuous, solid, planar or linear outer surface wall of the baluster when the baluster is received in the first interior and in the second interior.

2. The fencing assembly of claim 1, wherein the first rail further comprises a channel.

3. The fencing assembly of claim 2, wherein the first resilient retaining element is disposed in the channel.

4. The fencing assembly of claim 1, wherein the first rail further comprises an open bottom face and the baluster is received through the open bottom face into the first interior.

5. The fencing assembly of claim 1, further comprising apertures defined in the second rail.

6. The fencing assembly of claim 5, wherein the baluster is configured to be inserted into one of the apertures in the second rail.

7. The fencing assembly of claim 1, wherein the second rail includes a second retaining element.

8. The fencing assembly of claim 7, wherein the second retaining element is configured to frictionally retain a second end of the baluster relative to the second rail.

9. The fencing assembly of claim 7, wherein the second rail includes a second channel.

10. The fencing assembly of claim 9, wherein the second retaining element is disposed in the second channel.

11. The fencing assembly of claim 1, wherein the first rail and the second rail are parallel to one another.

12. The fencing assembly of claim 1, wherein the first rail and the second rail are parallel.

13. The fencing assembly of claim 1, further comprising a plurality of pairs of corresponding apertures defined in opposing faces of the first rail and second rail.

14. The fencing assembly of claim 13, further comprising a plurality of balusters, each baluster configured to be inserted into a respective one of the pairs of corresponding apertures in the first rail and the second rail.

15. The fencing assembly of claim 14, wherein each one of the pairs of corresponding apertures has a longitudinal length that is greater than a width of at least one of the plurality of balusters.

16. An assembly, comprising:

at least one rail, wherein the rail defines an interior and includes a resilient retaining element with at least one inward extending portion extending within the interior; and a baluster having at least one portion with a continuous planar or linear solid outer surface; and wherein the at least one inward extending portion of the resilient retaining element deflects away from, and frictionally engages with, the continuous planar or linear solid outer surface of the baluster when the baluster is received in the interior.

17. The assembly of claim 16, wherein the at least one rail comprises a plurality of rails, each defining corresponding interiors and provided with a corresponding resilient retaining element.

18. The assembly of claim 17, wherein the plurality of rails are coupled with the baluster such that the plurality of rails are parallel.

19. The assembly of claim 17, further comprising a plurality of apertures defined in at least one of the plurality of rails.

20. The assembly of claim 19, further comprising a plurality of balusters, each baluster configured to be inserted into a respective one of the plurality of apertures.

* * * * *